US010127871B2

(12) United States Patent
Toyoshima et al.

(10) Patent No.: US 10,127,871 B2
(45) Date of Patent: Nov. 13, 2018

(54) LIQUID CRYSTAL DISPLAY DEVICE INCLUDING A DETECTION CIRCUIT

(71) Applicant: Japan Display Inc., Tokyo (JP)

(72) Inventors: Yosuke Toyoshima, Tokyo (JP); Kensuke Shioda, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/071,619

(22) Filed: Mar. 16, 2016

(65) Prior Publication Data

US 2016/0275837 A1 Sep. 22, 2016

(30) Foreign Application Priority Data

Mar. 20, 2015 (JP) ..... 2015-058013
Mar. 4, 2016 (JP) ..... 2016-042807

(51) Int. Cl.
*G09G 3/00* (2006.01)
*G09G 3/36* (2006.01)

(52) U.S. Cl.
CPC ..... *G09G 3/3655* (2013.01); *G09G 2320/041* (2013.01); *G09G 2330/06* (2013.01); *G09G 2330/12* (2013.01)

(58) Field of Classification Search
CPC ..... G09G 3/3655; G09G 2320/041; G09G 2330/12; G09G 2330/06
See application file for complete search history.

(56) References Cited

U.S. PATENT DOCUMENTS

2009/0147164 A1* 6/2009 Toyoshima ..... G09G 3/3655 349/39
2011/0221983 A1* 9/2011 Lee ..... G09G 3/3655 349/33
2012/0218250 A1* 8/2012 Pei ..... G09G 3/3655 345/212
2014/0028535 A1* 1/2014 Min ..... G09G 3/18 345/87
2016/0203784 A1* 7/2016 Zhang ..... G09G 3/3696 345/211

FOREIGN PATENT DOCUMENTS

JP 2013-028238 2/2013

* cited by examiner

*Primary Examiner* — Kwang-Su Yang
(74) *Attorney, Agent, or Firm* — K&L Gates LLP

(57) ABSTRACT

According to an aspect, a liquid crystal display device includes a plurality of pixels arranged in a matrix in a display area; a scanning line that is coupled with pixels arranged in a row direction in the display area and is supplied with a scan signal; a signal line that is coupled with pixels arranged in a column direction in the display area and is supplied with a pixel signal; a common electrode that is commonly coupled with the pixels and is supplied with a common voltage; and a detection circuit that detects a transient potential variation component that is synchronized with the pixel signal and is superimposed on the common voltage.

11 Claims, 18 Drawing Sheets

LIQUID CRYSTAL DISPLAY DEVICE INCLUDING A DETECTION CIRCUIT

CROSS-REFERENCE TO RELATED APPLICATIONS

This application claims priority from Japanese Application No. 2015-058013, filed on Mar. 20, 2015, and Japanese Application No. 2016-042807, filed on Mar. 4, 2016, the contents of which are incorporated by reference herein in its entirety.

BACKGROUND

1. Technical Field

The present invention relates to a liquid crystal display device and a liquid crystal display system.

2. Description of the Related Art

In these years, liquid crystal display devices including liquid crystal panels are widely used as in-vehicle display devices, such as car navigation systems. A vehicle is equipped with a plurality of electronic control units for controlling various vehicle components, such as an engine and brakes. In general, each of such electronic control units is configured to make a self-failure diagnosis for failures and malfunctions, and outputs the results, as disclosed in Japanese Patent Application Laid-open Publication No. 2013-28238, for example.

An in-vehicle display device is also required to have a function to make a failure diagnosis for failures and malfunctions. A liquid crystal display device can be configured to make a self-diagnosis of each component unit constituting the liquid crystal display device, and it is specifically desired that the liquid crystal display device has a function to detect a failure, which appears as a failure in the display device, that is, there is a failure in a display operation of the display device.

For the foregoing reasons, there is a need for a liquid crystal display device and a liquid crystal display system that are capable of detecting a failure in a display operation.

SUMMARY

According to an aspect, a liquid crystal display device includes a plurality of pixels arranged in a matrix in a display area; a scanning line that is coupled with pixels arranged in a row direction in the display area and is supplied with a scan signal; a signal line that is coupled with pixels arranged in a column direction in the display area and is supplied with a pixel signal; a common electrode that is commonly coupled with the pixels and is supplied with a common voltage; and a detection circuit that detects a transient potential variation component that is synchronized with the pixel signal and is superimposed on the common voltage.

According to another aspect, a liquid crystal display system includes the liquid crystal display device; and a control device that determines that the liquid crystal display device is functioning abnormally or has stopped operating and that performs a certain abnormal case process, if the potential variation component is detected by the detection circuit.

DETAILED DESCRIPTION

Figure 1:
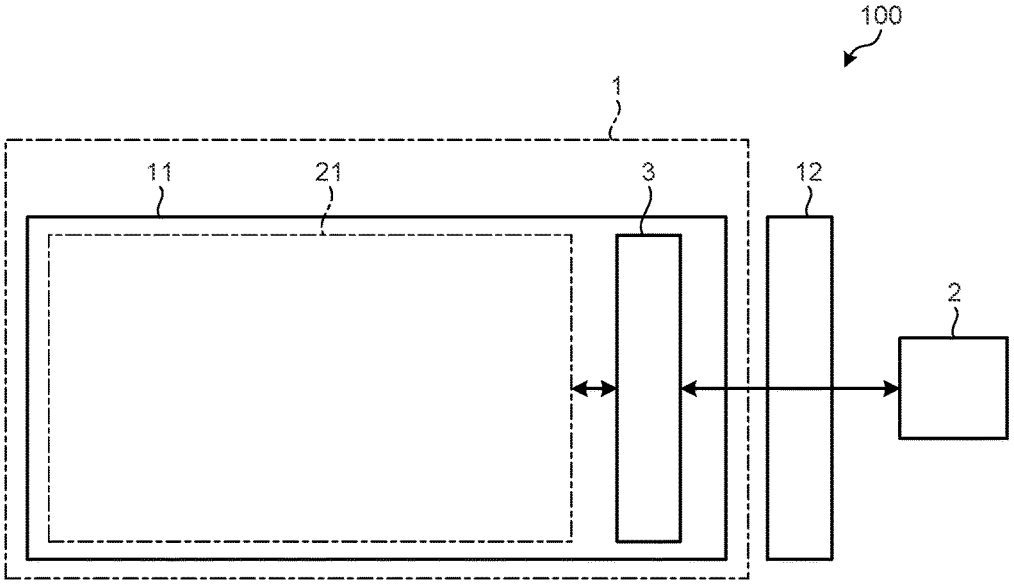
FIG. 1 is a diagram illustrating an example of a schematic configuration of a liquid crystal display system according to a first embodiment.

The following describes details of preferred embodiments for carrying out the invention with reference to the drawings. The present invention is not limited to the description of the embodiments to be given below. Components to be described below include a component or components that is/are easily conceivable by those skilled in the art or substantially the same component or components. Moreover, the components to be described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example, and interpretation of the invention is not limited thereto. The same element as that described in the drawing that has already been discussed is denoted by the same reference numeral through the description and the drawings, and detailed description thereof will not be repeated in some cases where appropriate.

First Embodiment

FIG. 1 is a diagram illustrating an example of a schematic configuration of a liquid crystal display system according to a first embodiment. This liquid crystal display system 100 according to the present embodiment includes a liquid crystal display device 1 and a control device 2.

The liquid crystal display device 1 includes a display area 21 and a driver IC 3 that are provided on a glass substrate 11, and the driver IC 3 is coupled with the control device 2 via a relay board 12 constituted by, for example, a flexible printed circuit (FPC), thus constituting the liquid crystal display system 100.

The control device 2 includes, for example, a central processing unit (CPU) and a storage device such as a memory, and uses these hardware resources to execute a program so as to be capable of implementing various functions in the liquid crystal display device 1. The control device 2 performs control so that the driver IC 3 can handle an image to be displayed on the liquid crystal display device 1 as information about the input gradation of the image, according to a result of execution of the program. The control device 2 has a function of making a display operation determination to determine whether a display operation of the liquid crystal display device 1 is functioning normally, and performing a certain process if the display operation of the liquid crystal display device 1 is not functioning normally, that is, if the liquid crystal display device 1 is functioning abnormally or has stopped operating.

Figure 2:
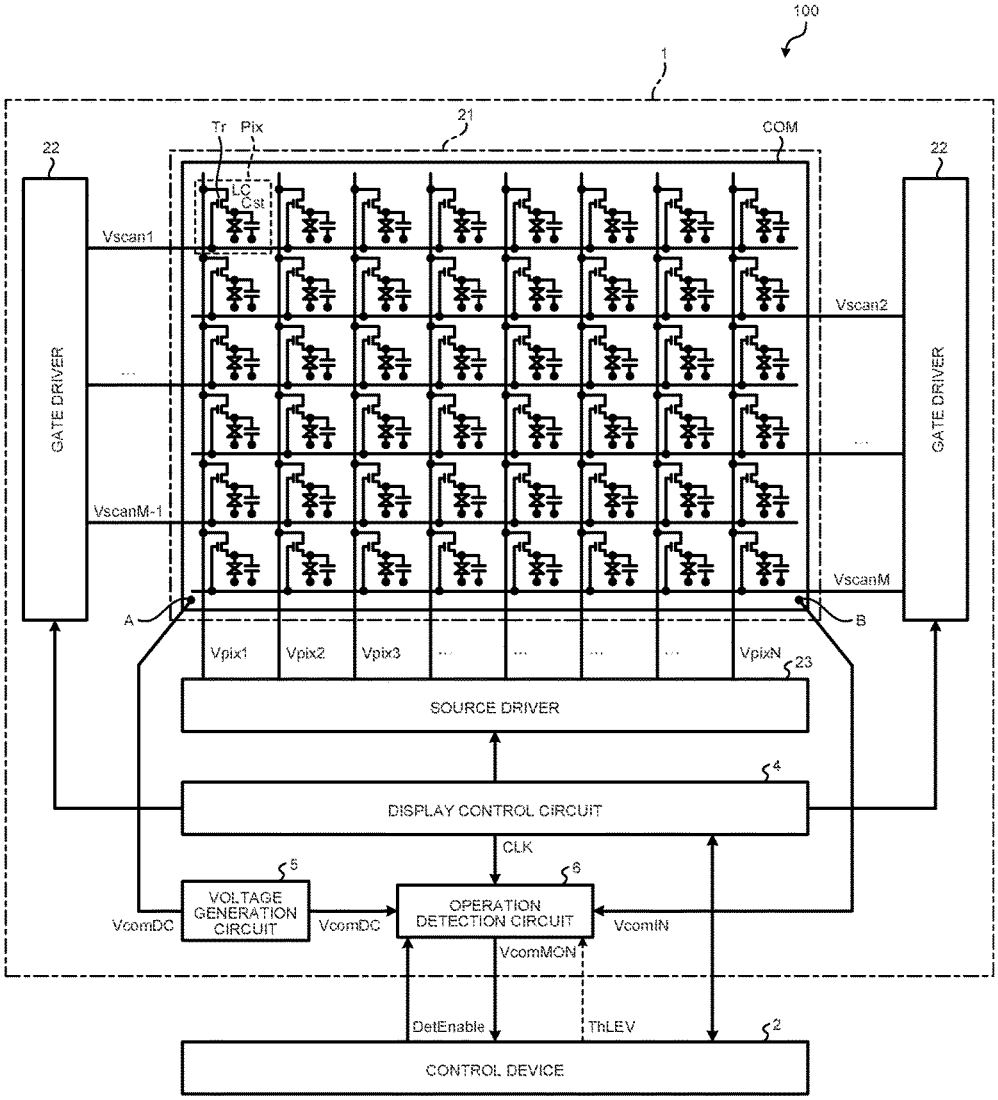
FIG. 2 is a diagram illustrating an example of a block configuration of a liquid crystal display device according to the first embodiment.

FIG. 2 is a diagram illustrating an example of a block configuration of the liquid crystal display device according to the first embodiment. The liquid crystal display device 1 according to the present embodiment includes the display area 21, a gate driver 22, a source driver 23, a display control circuit 4, a voltage generation circuit 5, and an operation detection circuit (detection circuit) 6. The display control circuit 4 has functions of a timing generator and an interface (I/F) between the gate driver 22 and the source driver 23, and the control device 2. In this example, the gate driver 22, the source driver 23, the display control circuit 4, the voltage generation circuit 5, and the operation detection circuit 6 are included in the driver IC 3 illustrated in FIG. 1. However, the present invention is not limited to this example.

The display area 21 has a matrix configuration formed by arranging M rows by N columns of a plurality of pixels Pix. In this description, a row refers to a pixel row including N pixels Pix arranged in one direction; a column refers to a pixel column including M pixels Pix arranged in a direction orthogonal to or intersecting the one direction; and the values of M and N are determined according to a vertical display resolution and a horizontal display resolution.

Each of the pixels Pix includes a TFT element Tr and a liquid crystal element LC. Each of the pixels Pix is also provided with a capacitive element Cst in parallel with the liquid crystal element LC.

In the display area 21, scanning lines for the respective rows and signal lines for the respective columns are wired with respect to the array of M rows by N columns of the pixels Pix. The scanning lines are supplied with respective scan signals Vscan(1, 2, . . . , M) from the gate driver 22. The signal lines are supplied with respective pixel signals Vpix (1, 2, . . . , N) from the source driver 23. The scan signals Vscan(1, 2, . . . , M) are supplied to the gates of the TFT elements Tr included in the respective pixels Pix. The pixel signals Vpix(1, 2, . . . , N) are supplied to the sources of the TFT elements Tr included in the respective pixels Pix.

The drain of the TFT element Tr of each of the pixels Pix is coupled with an end of the liquid crystal element LC and an end of the capacitive element Cst. The other ends of the liquid crystal element LC and the capacitive element Cst of each of the pixels Pix are coupled with a common electrode COM formed over the entire area of the display area 21. In the present embodiment, the common electrode COM is a transparent electrode provided common to all the pixels Pix in the display area 21. A common voltage VcomDC is applied from the voltage generation circuit 5 to a common voltage application position A provided on the common electrode COM. In other words, the liquid crystal display device 1 in the present embodiment is a liquid crystal display device using what is called a common DC type.

The example illustrated in FIG. 2 is an example of providing the common electrode COM common to all the pixels Pix in the display area 21. However, the common electrode COM may be divided into a plurality of common electrodes, each of which being provided in each column or each group of a plurality of columns. The other end of the capacitive element Cst may be coupled with wiring for supplying a certain electric potential other than that of the common electrode COM.

The liquid crystal display device 1 may be a liquid crystal display device using what is called a common inversion type of inverting a voltage applied to the common electrode COM for each frame.

In order to detect a variation in a potential of the common electrode COM corresponding to a variation in each of the pixel signals Vpix, the operation detection circuit 6 is supplied from the display control circuit 4 with a clock signal CLK in synchronization with the variation in each of the pixel signals Vpix. In order to prevent an omission in reading of the variation in the potential of the common electrode COM, the operation detection circuit 6 is supplied with the clock signal CLK that takes into account delay time and fluctuations of internal signals. Specifically, a clock edge (such as a rising edge) of the clock signal CLK for reading a potential variation component detection signal VcomDET is supplied later, by a short time, than a voltage variation edge (a rising edge or a falling edge) of each of the pixel signals Vpix. The operation detection circuit 6 is supplied from the voltage generation circuit 5 with the common voltage VcomDC applied to the common electrode COM, and is also supplied with a common voltage detection signal VcomIN detected at a common voltage detection position B separate from the common voltage application position A of the common electrode COM. While the certain voltage is supplied from the voltage generation circuit 5 to the common voltage application position A of the common electrode COM, the electric potential of the common voltage detection position B varies with the voltage variation in each of the pixel signals Vpix because the common electrode COM has a certain impedance. The operation detection circuit 6 is supplied from the control device 2 with an operation detection enable signal DetEnable for selecting whether to output an output result of the operation detection circuit 6. The operation detection circuit 6 may be supplied further with a threshold setting signal ThLEV for setting a threshold Th used in a potential variation detector 61 (to be described later).

Figure 3:
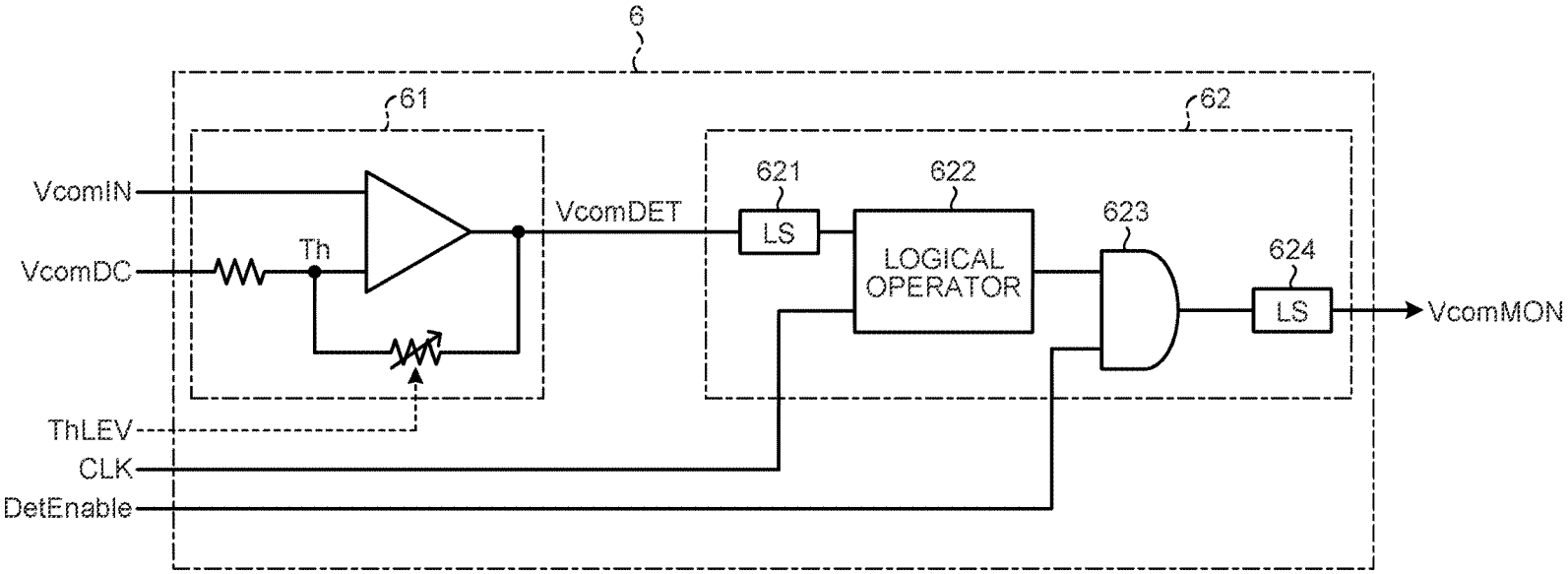
FIG. 3 is a diagram illustrating an example of a block configuration of an operation detection circuit in the liquid crystal display device according to the first embodiment.

FIG. 3 is a diagram illustrating an example of a block configuration of the operation detection circuit in the liquid crystal display device according to the first embodiment.

The operation detection circuit 6 includes the potential variation detector 61 and an operational state signal generator 62.

As an example, the potential variation detector 61 includes a comparator circuit and resistors for setting the threshold, and is configured to determine the threshold based on the voltage of a VcomDC terminal supplied with the voltage of the common electrode COM and on the resistance values. The value of the threshold setting signal ThLEV can be set for the potential variation detector 61 through a register setting in the control device 2, and the threshold setting signal ThLEV, in turn, sets the resistance value of a variable resistor so that the threshold Th of the potential variation detector 61 can be appropriately set. The potential variation detector 61 extracts a potential variation component exceeding the threshold Th from the common voltage detection signal VcomIN, and outputs the potential variation component detection signal VcomDET. In the example illustrated in FIGS. 2 and 3, the threshold setting signal ThLEV is supplied from the control device 2. However, the threshold setting signal ThLEV may be supplied from the display control circuit 4.

The operational state signal generator 62 has a function of processing the potential variation component detection signal VcomDET output from the potential variation detector 61 so as to generate an operational state detection signal VcomMON that indicates an operational state of the liquid crystal display device 1, and outputting the operational state detection signal VcomMON to the control device 2.

In the example illustrated in FIG. 3, the operational state signal generator 62 includes a level shifter (LS) 621, a logical operator 622, an AND operator 623, and a level shifter (LS) 624.

The level shifter 621 is a functional block for shifting the voltage level of the potential variation component detection signal VcomDET output from the potential variation detector 61 to a voltage level that can be handled as a digital signal in the logical operator 622 at the subsequent stage and for outputting the shifted signal.

The logical operator 622 includes a circuit for acquiring the potential variation component detection signal VcomDET detected by the potential variation detector 61. The clock signal CLK supplied to the logical operator 622 is in synchronization with the potential variation component detection signal VcomDET so that the logical operator 622 can acquire the potential variation component detection signal VcomDET. Moreover, in order to prevent an omission in reading of the variation in the potential of the common electrode COM, the logical operator 622 is supplied with the clock signal CLK that takes into account the delay time and the fluctuations of the internal signals. Specifically, the clock edge (such as a rising edge) of the clock signal CLK for reading the potential variation component detection signal VcomDET is supplied later, by a short time, than the voltage variation edge (a rising edge or a falling edge) of each of the pixel signals Vpix and the potential variation component detection signal VcomDET. The potential variation component detection signal VcomDET may be read at a falling edge of the clock signal CLK. The logical operator 622 includes, for example, a flip-flop. As will be described later, the logical operator 622 is, as an example, a functional block for converting a potential variation component of the common voltage Vcom into a signal that is switched between a low level and a high level at intervals of one horizontal period (1H).

The AND operator 623 is a functional block for selecting, based on the operation detection enable signal DetEnable supplied from the control device 2, whether to output the output result of the operation detection circuit 6 to the control device 2.

The level shifter 624 is a functional block for shifting the output of the AND operator 623 to a voltage level that can be handled by the control device 2 at the subsequent stage, and for outputting the shifted signal, as the operational state detection signal VcomMON.

Figure 4:
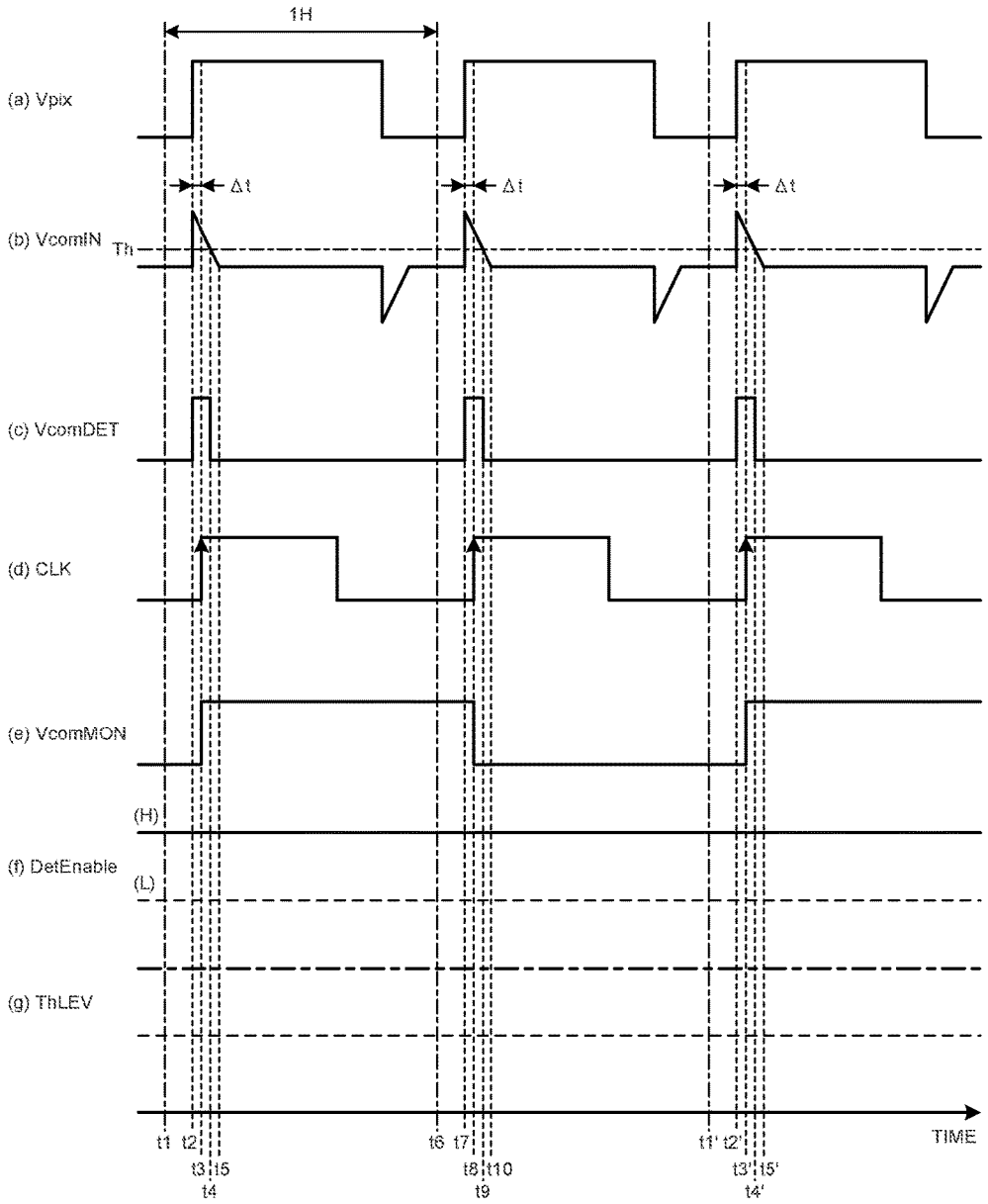
FIG. 4 is a diagram illustrating an example of a timing diagram during a normal operation of the liquid crystal display device according to the first embodiment.

FIG. 4 is a diagram illustrating an example of a timing diagram during a normal operation of the liquid crystal display device according to the first embodiment. Row (a) of FIG. 4 illustrates a waveform of each of the pixel signals Vpix supplied from the source driver 23 to corresponding one of the signal lines. Row (b) of FIG. 4 illustrates a waveform of the common voltage detection signal VcomIN detected at the common voltage detection position B of the common electrode COM. Row (c) of FIG. 4 illustrates a waveform of the potential variation component detection signal VcomDET output from the potential variation detector 61. Row (d) of FIG. 4 illustrates a waveform of the clock signal CLK output from the display control circuit 4. Row (e) of FIG. 4 illustrates a waveform of the operational state detection signal VcomMON output from the operation detection circuit 6. Row (f) of FIG. 4 illustrates the operation detection enable signal DetEnable supplied from the control device 2. Row (g) of FIG. 4 illustrates the threshold setting signal ThLEV supplied from the control device 2. In this example, the potential variation component detection signal VcomDET is acquired at rising edges of the clock signal CLK. However, the potential variation component detection signal VcomDET may be acquired at falling edges of the clock signal CLK.

Figure 5:
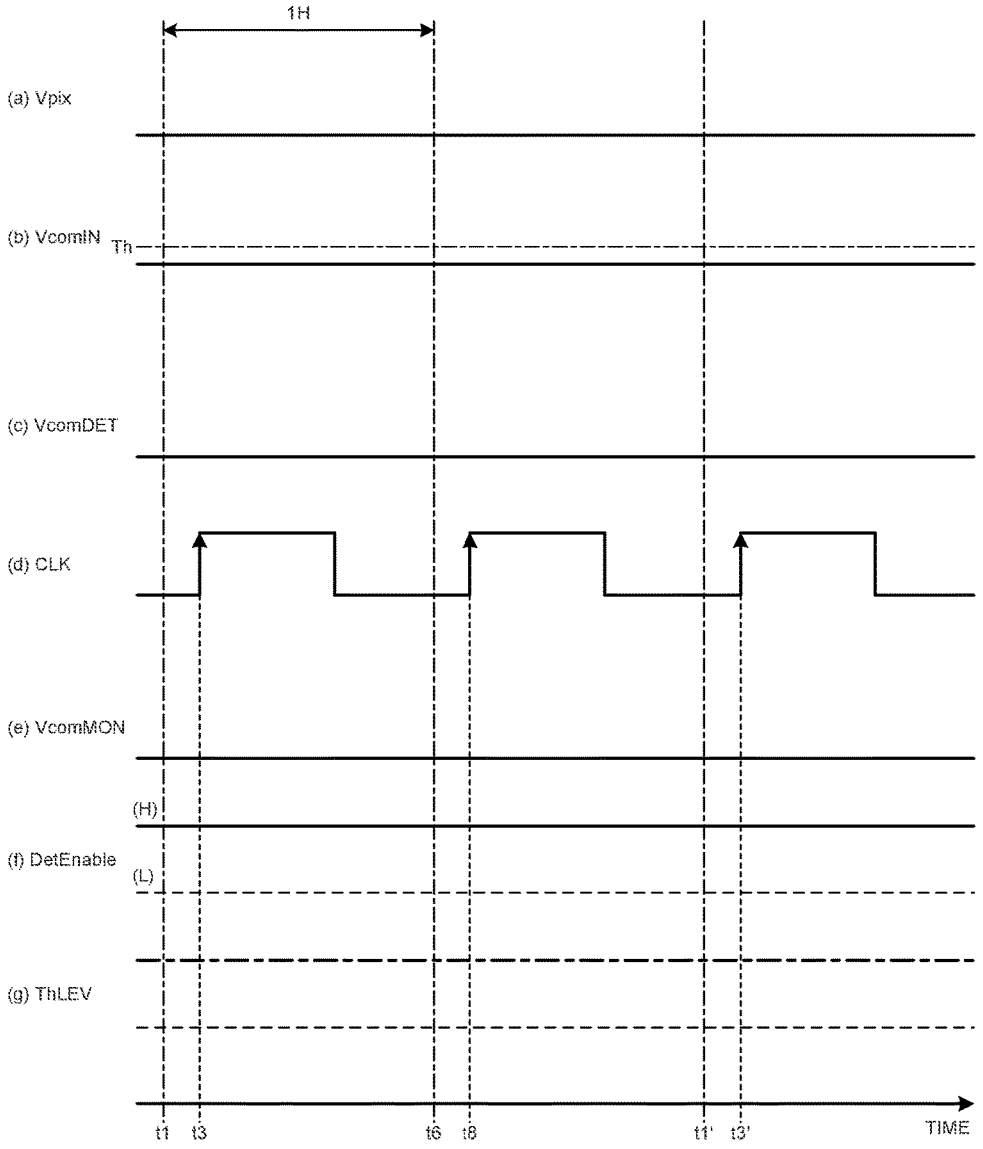
FIG. 5 is a diagram illustrating an example of a timing diagram during an abnormal operation of the liquid crystal display device according to the first embodiment.

FIG. 5 is a diagram illustrating an example of a timing diagram during an abnormal operation of the liquid crystal display device according to the first embodiment. Row (a) of FIG. 5 illustrates a waveform of each of the pixel signals Vpix supplied from the source driver 23 to corresponding one of the signal lines. Row (b) of FIG. 5 illustrates a waveform of the common voltage detection signal VcomIN detected at the common voltage detection position B of the common electrode COM. Row (c) of FIG. 5 illustrates a waveform of the potential variation component detection signal VcomDET output from the potential variation detector 61. Row (d) of FIG. 5 illustrates a waveform of the clock signal CLK output from the display control circuit 4. Row (e) of FIG. 5 illustrates a waveform of the operational state detection signal VcomMON output from the operation detection circuit 6. Row (f) of FIG. 5 illustrates the operation detection enable signal DetEnable supplied from the control device 2. Row (g) of FIG. 5 illustrates the threshold setting signal ThLEV supplied from the control device 2. The resistance value of the variable resistor may be varied as follows: a certain voltage value is supplied as the threshold setting signal ThLEV illustrated in Row (g) of FIG. 4 and Row (g) of FIG. 5, and the resistance value of the variable resistor is varied by the analog voltage value; or the resistance value of the variable resistor is varied by the signal having a digital value. A resistor ladder in which a plurality of resistors are coupled in series may be used as an example of the variable resistor, and the variable resistance value thereof may be varied by short-circuiting or opening both ends of each the resistors by using switches, such as transistors. A resistor configuration in which a plurality of resistors are coupled in parallel may be used as an example of the variable resistor, and the variable resistance value thereof may be varied by coupling or uncoupling an end of each of the resistors to or from ends of the other resistors. As an example of varying the variable resistance value using the analog voltage, the resistance value of the variable resistor may be varied by recognizing the analog voltage supplied through a plurality of thresholds, and controlling on/off of the transistors of the variable resistor according to the result of the recognition. As an example of varying the variable resistance value using the digital signal, the transistors of the variable resistor may be on/off controlled according to the supplied digital signal. In this case, the digital signal may be supplied as parallel signals, and the transistors may be on/off controlled by the respective signals, or alternatively, the digital signal may be supplied as a serial signal, and the serial signal may be converted into parallel signals to be used for controlling on/off of the respective transistors.

In the liquid crystal display device 1 according to the first embodiment illustrated in FIG. 2, parasitic capacitance is generated between each of the signal lines supplied with the pixel signals Vpix and the common electrode COM. Each of the pixels Pix is provided with the capacitive element Cst in parallel with the liquid crystal element LC, as described above.

If the liquid crystal display device 1 according to the first embodiment is functioning normally, a transient potential variation component as illustrated in Row (b) of FIG. 4 is superimposed on the common voltage VcomDC on the common electrode COM in synchronization with the rising and the falling of the pixel signal Vpix, via the above-mentioned parasitic capacitance generated between the signal line and the common electrode COM, and via the capacitive element Cst formed in the pixel Pix selected by the scan signal Vscan.

If, for example, a failure occurs in the display operation of the liquid crystal display device 1 according to the first embodiment and the liquid crystal display device 1 is not functioning normally, the pixel signal Vpix to be supplied to the pixel Pix is considered to have failed to be output, as illustrated in Row (a) of FIG. 5. In this case, as illustrated in Row (b) of FIG. 5, the transient potential variation component as illustrated in Row (b) of FIG. 4 is not superimposed on the common voltage VcomDC on the common electrode COM.

In the present embodiment, the common voltage detection signal VcomIN supplied from the common electrode COM is monitored, and the transient potential variation component in synchronization with rising edges (or falling edges) of the pixel signal Vpix is detected. Thus, it is possible to determine whether the liquid crystal display device 1 according to the first embodiment is functioning normally.

In the present embodiment, the operational state detection signal VcomMON is output in the following manner. If the potential variation component in synchronization with the pixel signal Vpix is detected from the common voltage detection signal VcomIN supplied from the common electrode COM, the operational state detection signal VcomMON is output as a first signal indicating that the potential variation component of the common electrode COM is detected (Row (e) of FIG. 4). Here, the first signal is a signal switched between a low level and a high level at the rising edges of the clock signal CLK, that is, a signal switched between the low level and the high level at intervals of one horizontal period (1H). If the variation component in synchronization with the pixel signal Vpix is not detected from the common voltage detection signal VcomIN supplied from the common electrode COM, the operational state detection signal VcomMON is output as a second signal indicating that the potential variation component of the common electrode COM is not detected (Row (e) of FIG. 5). Here, the second signal is a signal fixed to the low level or the high level. Accordingly, the control device 2 at the subsequent stage monitors the operational state detection signal VcomMON output from the operation detection circuit 6, and makes the display operation determination to determine whether the liquid crystal display device 1 is functioning normally. If the control device 2 detects the first signal indicating that the potential variation component of the common electrode COM is detected, the control device 2 determines that the liquid crystal display device 1 is functioning normally. If the control device 2 detects the second signal indicating that the potential variation component of the common electrode COM is not detected, the control device 2 determines that the liquid crystal display device 1 is functioning abnormally or has stopped operating, and performs a certain process (hereinafter, also called an "abnormal case process").

Conceivable examples of the abnormal case process include, but are not limited to, a process of restarting the liquid crystal display device 1, a process of forcing a termination of the operation of the liquid crystal display device 1, and a process of disallowing restarts of the liquid crystal display device 1 if a failure has been detected more than once. The present invention is not limited by the method of the abnormal case process.

The wave height value of the pixel signal Vpix varies with the gradation of the image to be displayed in the display area 21. A change in the wave height value of the pixel signal Vpix changes the voltage variation level of the common electrode COM. The example illustrated above is an example in which the threshold Th used for comparison with the common voltage detection signal VcomIN is set in the register on the assumption that the wave height value of the pixel signal Vpix falls within a certain range. However, it is more preferable that the threshold Th is dynamically varied by supplying, from the control device 2, the signal ThLEV corresponding to the variation in the wave height value of the pixel signal Vpix.

The potential variation component of the common electrode COM that is synchronized with the pixel signal Vpix, and superimposed on the common voltage VcomDC increases as the position thereof is farther from the position (common voltage application position A) on the common electrode COM where the common voltage VcomDC is supplied from the voltage generation circuit 5. Therefore, in the example illustrated in FIG. 2, the position (common voltage detection position B) on the common electrode COM for detecting the common voltage detection signal VcomIN is preferably farther from the position (common voltage application position A) on the common electrode COM where the common voltage VcomDC is supplied from the voltage generation circuit 5.

The example in Row (e) of FIG. 4 is illustrated as an example of the operational state detection signal VcomMON in which the signal is switched between the low level and the high level at intervals of one horizontal period (1H), that is, the signal is switched between the low level and the high level at a rising edge of the clock signal CLK supplied from the display control circuit 4 at intervals of one horizontal period (1H). However, the present invention is naturally not limited to this example. The present invention is not limited to the above-described example provided that the operational state detection signal VcomMON is usable for detecting whether the potential variation component of the common electrode COM is present.

Figure 6:
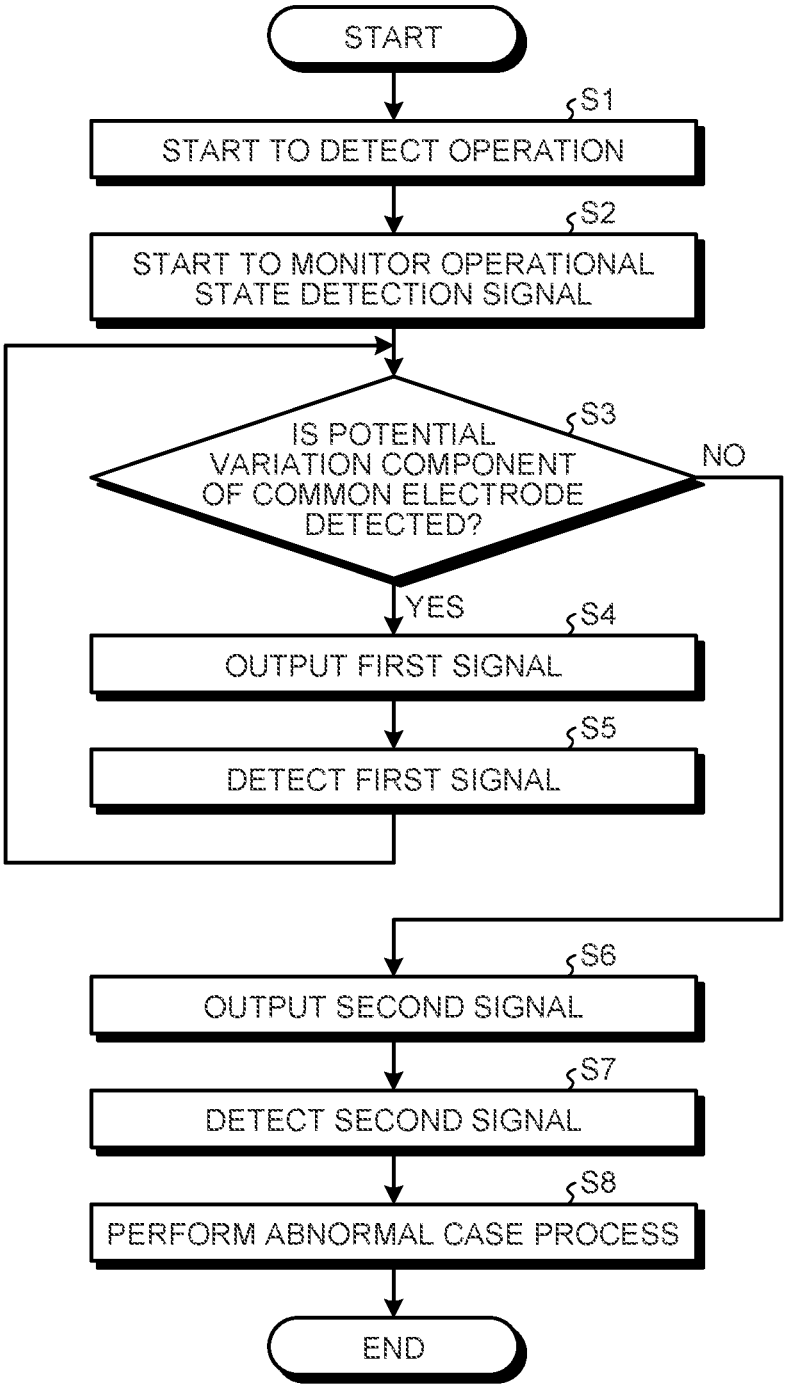
FIG. 6 is a diagram illustrating an example of a specific processing procedure in the liquid crystal display system according to the first embodiment.

The following describes a specific processing procedure in the liquid crystal display system 100 according to the first embodiment, with reference to FIGS. 2 to 6. FIG. 6 is a diagram illustrating an example of the specific processing procedure in the liquid crystal display system according to the first embodiment.

After the liquid crystal display device 1 starts operating, the operation detection enable signal DetEnable (high-level signal) and the threshold setting signal ThLEV are supplied from the control device 2 to the operation detection circuit 6. The supply of the threshold setting signal ThLEV sets the threshold Th of the potential variation detector 61 through the register setting. The operation detection circuit 6 compares the common voltage detection signal VcomIN from the common electrode COM with the threshold Th, and starts to detect the operation (Step S1). The control device 2 starts to monitor the operational state detection signal VcomMON (Step S2).

When the common voltage detection signal VcomIN exceeds the threshold Th (in periods of t2 to t4, t7 to t9, and t2' to t4' in Row (b) of FIG. 4), the potential variation component detection signal VcomDET changes from a low level to a high level at points where the common voltage detection signal VcomIN exceeds the threshold Th (in periods of t2 to t4, t7 to t9, and t2' to t4' in Row (c) of FIG. 4). When the common voltage detection signal VcomIN does not exceed the threshold Th, the potential variation component detection signal VcomDET remains at the low level (Row (c) of FIG. 5).

The operational state signal generator 62 determines whether the level of the potential variation component detection signal VcomDET is the high level, at rising edges of the clock signal CLK supplied from the display control circuit 4 that rise at times (at t3, t8, and t3' in Row (d) of FIG. 4, and at t3, t8, and t3' in Row (d) of FIG. 5) later, by a short time Δt, than the rising edges of the pixel signal Vpix. In this manner, the operational state signal generator 62 determines whether the potential variation component of the common electrode COM is detected (Step S3).

If the level of the potential variation component detection signal VcomDET is the high level at a rising edge of the clock signal CLK, that is, if the potential variation component of the common electrode COM is detected (Yes at Step S3), the operational state signal generator 62 outputs, as the operational state detection signal VcomMON, the first signal indicating that the potential variation component of the common electrode COM is detected, based on the operation detection enable signal DetEnable (high-level signal) (Step S4). Here, the first signal is a signal switched between the low level and the high level at the rising edges of the clock signal CLK, that is, a signal switched between the low level and the high level at intervals of one horizontal period (1H).

After detecting the first signal output at Step S4 (Step S5), the control device 2 determines that the liquid crystal display device 1 is functioning normally, so that the process returns to Step S3.

If the level of the potential variation component detection signal VcomDET is the low level at the rising edge of the clock signal CLK, that is, if the potential variation component of the common electrode COM is not detected (No at Step S3), the operational state signal generator 62 outputs, as the operational state detection signal VcomMON, the second signal indicating that the potential variation component of the common electrode COM is not detected (Step S6). Here, the second signal is a signal fixed to the low level.

After detecting the second signal output at Step S6 (Step S7), the control device 2 determines that the liquid crystal display device 1 is functioning abnormally or has stopped operating, and performs the certain abnormal case process (Step S8). Then, the process of this procedure ends.

The execution of the processing procedure described above allows the liquid crystal display device 1 according to the first embodiment to detect a failure in the display operation.

As is clear from FIG. 4, one potential variation component of the common voltage detection signal VcomIN (positive side variation component) changes toward the positive side along with the rise of the pixel signal Vpix, while the other potential variation component of the common voltage detection signal VcomIN (negative side variation component) changes toward the negative side along with the fall of the pixel signal Vpix. In the present embodiment, the example has been described in which a value for detecting the positive side variation component of the common voltage detection signal VcomIN is defined as the threshold setting signal ThLEV to be supplied from the control device 2, and the potential variation component exceeding the threshold Th, that is, the potential variation component higher than the threshold Th is extracted from the common voltage detection signal VcomIN. However, the extraction process may naturally be configured such that a value for detecting the negative side variation component of the common voltage detection signal VcomIN is defined as the threshold setting signal ThLEV to be supplied from the control device 2, and the potential variation component lower than the threshold Th is extracted from the common voltage detection signal VcomIN.

As described above, the liquid crystal display device 1 according to the first embodiment includes the operation detection circuit 6, and the operation detection circuit 6 detects the transient potential variation component that is synchronized with the pixel signal Vpix and superimposed on the common voltage VcomDC, via the parasitic capacitance formed between the signal line and the common electrode COM, and via the capacitive element Cst formed in each pixel Pix selected by the scan signal Vscan. This configuration enables the determination of whether the liquid crystal display device 1 is functioning normally.

The liquid crystal display system 100 according to the first embodiment includes the control device 2, and the control device 2 determines that the liquid crystal display device 1 is functioning abnormally or has stopped operating and performs the certain abnormal case process, if the potential variation component superimposed on the common voltage VcomDC is not detected. This configuration allows the appropriate abnormal case process to be performed while the liquid crystal display device 1 is functioning abnormally or has stopped operating.

The present embodiment can provide the liquid crystal display device 1 and the liquid crystal display system 100 that are capable of detecting a failure in the display operation.

Second Embodiment

Figure 7:
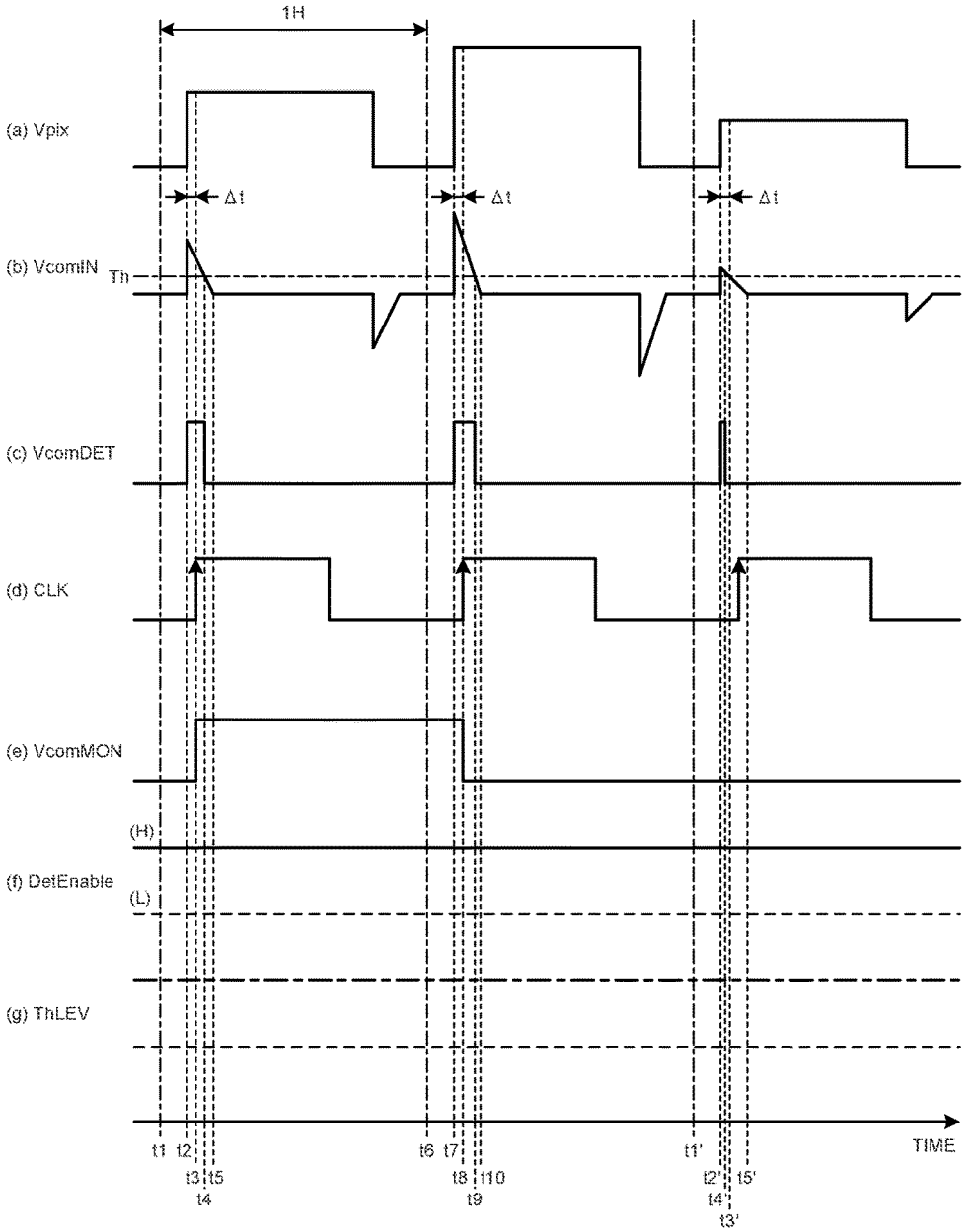
FIG.7 RELATED ART
FIG. 7 is a diagram illustrating an example of a timing diagram during a normal operation in a comparative example to be compared with a liquid crystal display device according to a second embodiment.

FIG. 7 is a diagram illustrating an example of a timing diagram during the normal operation in a comparative example to be compared with a liquid crystal display device according to a second embodiment. The schematic configuration of the liquid crystal display system, the block configuration of the liquid crystal display device, and the block configuration of the operation detection circuit in the liquid crystal display device according to the second embodiment are the same as those of the first embodiment described above, so that the description thereof will not be repeated.

Row (a) of FIG. 7 illustrates a waveform of each of the pixel signals Vpix supplied from the source driver 23 to corresponding one of the signal lines. Row (b) of FIG. 7 illustrates a waveform of the common voltage detection signal VcomIN detected at the common voltage detection position B of the common electrode COM. Row (c) of FIG. 7 illustrates a waveform of the potential variation component detection signal VcomDET output from the potential variation detector 61. Row (d) of FIG. 7 illustrates a waveform of the clock signal CLK output from the display control circuit 4. Row (e) of FIG. 7 illustrates a waveform of the operational state detection signal VcomMON output from the operation detection circuit 6. Row (f) of FIG. 7 illustrates the operation detection enable signal DetEnable supplied from the control device 2. Row (g) of FIG. 7 illustrates the threshold setting signal ThLEV supplied from the control device 2.

Figure 8:
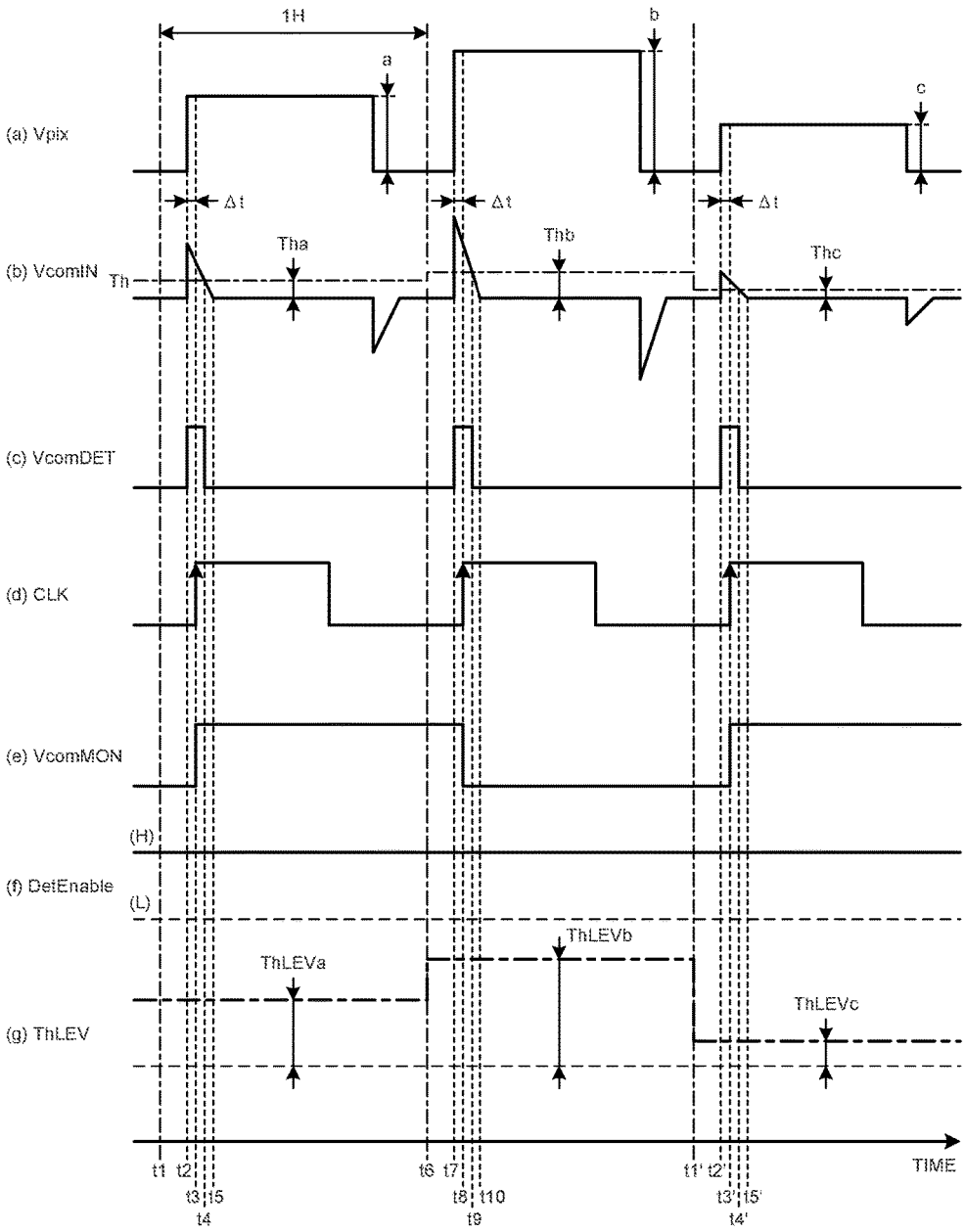
FIG. 8 is a diagram illustrating an example of a timing diagram during the normal operation of the liquid crystal display device according to the second embodiment.

FIG. 8 is a diagram illustrating an example of a timing diagram during the normal operation of the liquid crystal display device according to the second embodiment. Row (a) of FIG. 8 illustrates a waveform of each of the pixel signals Vpix supplied from the source driver 23 to corresponding one of the signal lines. Row (b) of FIG. 8 illustrates a waveform of the common voltage detection signal VcomIN detected at the common voltage detection position B of the common electrode COM. Row (c) of FIG. 8 illustrates a waveform of the potential variation component detection signal VcomDET output from the potential variation detector 61. Row (d) of FIG. 8 illustrates a waveform of the clock signal CLK output from the display control circuit 4. Row (e) of FIG. 8 illustrates a waveform of the operational state detection signal VcomMON output from the operation detection circuit 6. Row (f) of FIG. 8 illustrates the operation detection enable signal DetEnable supplied from the control device 2. Row (g) of FIG. 8 illustrates the threshold setting signal ThLEV supplied from the control device 2. In the examples illustrated in FIGS. 7 and 8, the potential variation component detection signal VcomDET is acquired at rising edges of the clock signal CLK, in the same manner as in the first embodiment. However, the potential variation component detection signal VcomDET may be acquired at falling edges of the clock signal CLK.

In a configuration in which the value of the threshold setting signal ThLEV is set to a constant voltage value through the register setting in the control device 2 so that the threshold Th used for the comparison with the common voltage detection signal VcomIN does not change from a constant value, if the wave height value of the pixel signal Vpix greatly varies at intervals of one horizontal period (1H) as illustrated in FIGS. 7 and 8, the pulse width of the potential variation component detection signal VcomDET varies as illustrated in FIG. 7. A reduction in the pulse width of the potential variation component detection signal VcomDET may cause a case in which the common voltage detection signal VcomIN does not exceed the threshold Th, or may cause, as illustrated in FIG. 7, a case in which a falling edge of the potential variation component detection signal VcomDET occurs (at t4' in Row (c) of FIG. 7) earlier than a rising edge of the clock signal CLK (at t3' in Row (d) of FIG. 7). In other words, the pulse width of the potential variation component detection signal VcomDET may decrease to be smaller than the short time Δt until the rising edge of the clock signal CLK that rises later than the pixel signal Vpix. In this event, the operational state signal generator 62 outputs the second signal indicating that the potential variation component of the common electrode COM is not detected, as the operational state detection signal VcomMON. In other words, the liquid crystal display device 1 may be falsely detected as being functioning abnormally or having stopped operating even though the liquid crystal display device 1 is functioning normally.

To counter this problem, in the present embodiment, the control device 2 supplies the threshold setting signal ThLEV (Row (g) of FIG. 8) corresponding to the variation in the wave height value of the pixel signal Vpix (Row (a) of FIG. 8) so as to dynamically vary the threshold Th (Row (b) of FIG. 8). Specifically, as illustrated in FIG. 8, the threshold setting signal ThLEV is set to ThLEVa, at t1, with respect to a wave height value a of the pixel signal Vpix so as to set the threshold Th to Tha; the threshold setting signal ThLEV is set to ThLEVb, at t6, with respect to a wave height value b of the pixel signal Vpix so as to set the threshold Th to Thb; and the threshold setting signal ThLEV is set to ThLEVc, at t1', with respect to a wave height value c of the pixel signal Vpix so as to set the threshold Th to Thc. This operation changes the threshold setting signal ThLEV from ThLEVa to ThLEVb according to the change in the wave height value of the pixel signal Vpix from a to b so as to change the threshold Th from Tha to Thb, and then, changes the threshold setting signal ThLEV from ThLEVb to ThLEVc according to the change in the wave height value of the pixel signal Vpix from b to c so as to change the threshold Th from Thb to Thc. In this manner, the detection accuracy of the common voltage detection signal VcomIN can be improved, and the pulse width of the potential variation component detection signal VcomDET can be restrained from varying due to the variation in the wave height value of the pixel signal Vpix (Row (c) of FIG. 8). This configuration can prevent the falling edge of the potential variation component detection signal VcomDET (at t4' in Row (c) of FIG. 8) from occurring earlier than the rising edge of the clock signal CLK (at t3' in Row (d) of FIG. 8). In other words, the pulse width of the potential variation component detection signal VcomDET can be prevented from decreasing to be smaller than the short time Δt until the rising edge of the clock signal CLK that rises later than the pixel signal Vpix. In this case, the operational state signal generator 62 outputs the first signal indicating that the potential variation component of the common electrode COM is detected, as the operational state detection signal VcomMON. In other words, the liquid crystal display device 1 can be prevented from being falsely detected as being functioning abnormally or having stopped operating while the liquid crystal display device 1 is functioning normally.

As described above, the liquid crystal display device 1 according to the second embodiment supplies the threshold setting signal ThLEV corresponding to the variation in the wave height value of the pixel signal Vpix from the control device 2 so as to dynamically vary the threshold Th. This configuration can improve the detection accuracy of the common voltage detection signal VcomIN. In the liquid crystal display system 100 according to the second embodiment, the liquid crystal display device 1 can be prevented from being falsely detected as being functioning abnormally or having stopped operating while the liquid crystal display device 1 is functioning normally.

Third Embodiment

Figure 9:
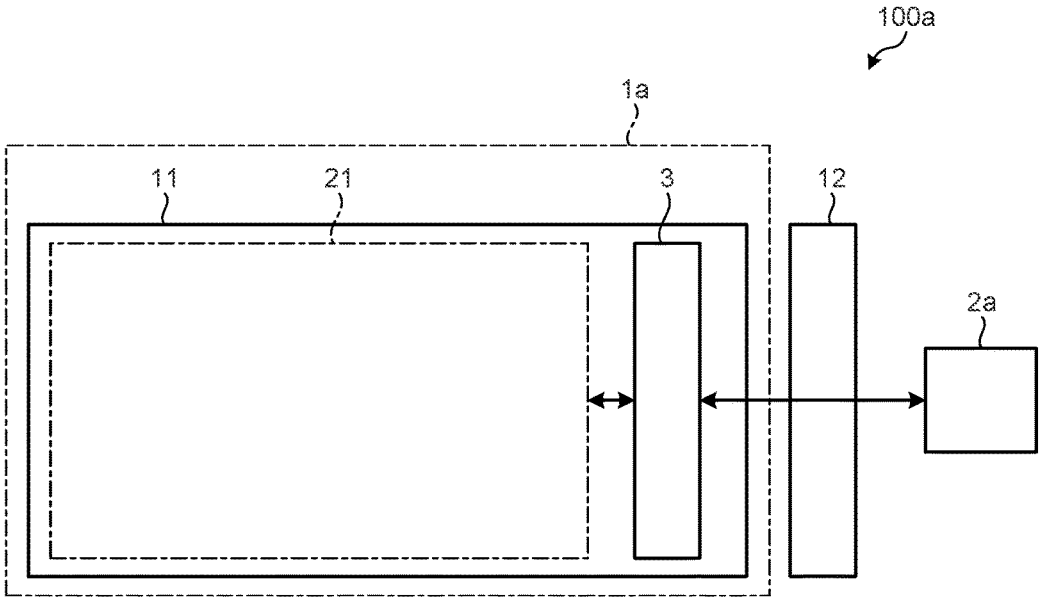
FIG. 9 is a diagram illustrating an example of a schematic configuration of a liquid crystal display system according to a third embodiment.
Figure 10:
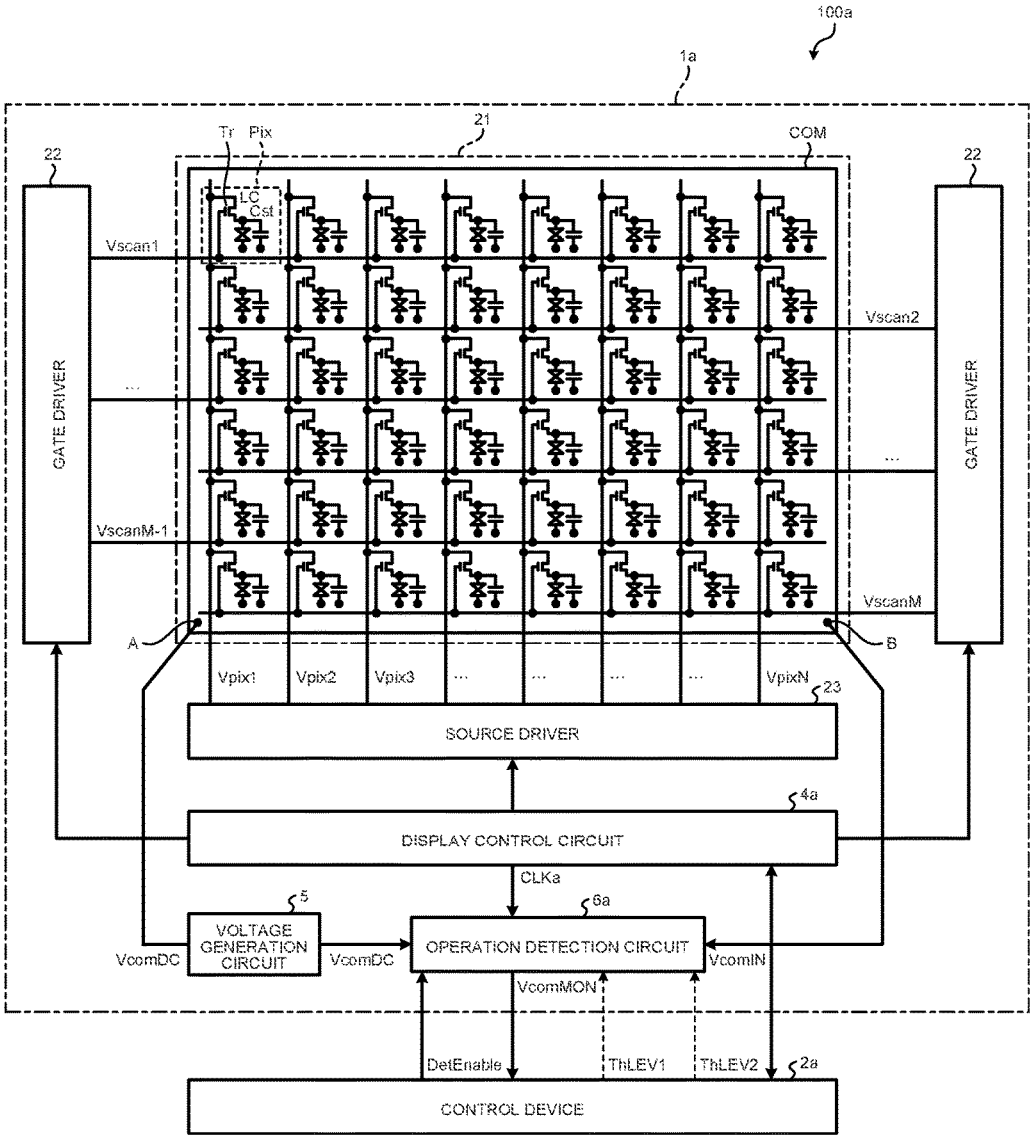
FIG. 10 is a diagram illustrating an example of a block configuration of a liquid crystal display device according to the third embodiment.
Figure 11:
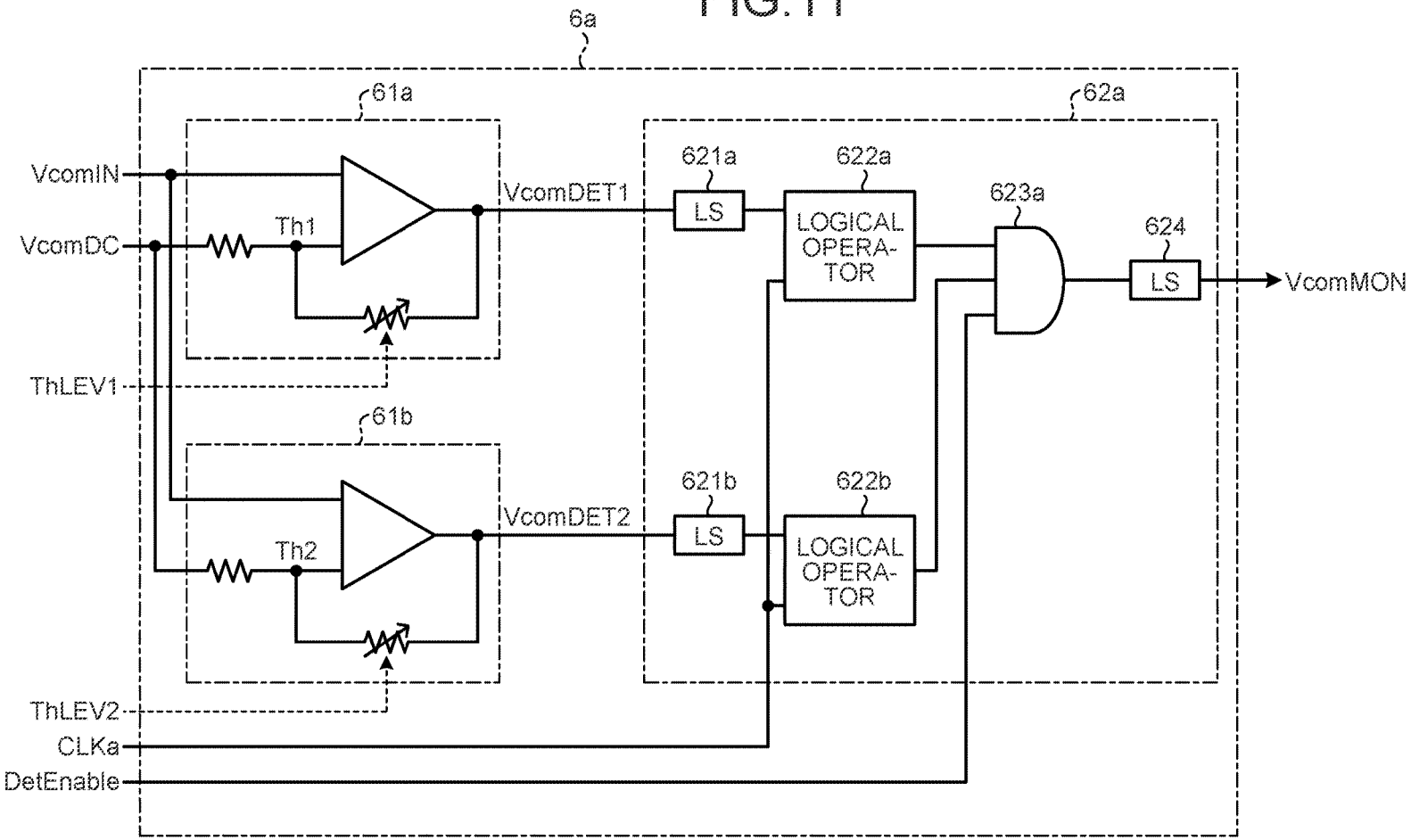
FIG. 11 is a diagram illustrating an example of a block configuration of an operation detection circuit in the liquid crystal display device according to the third embodiment.

FIG. 9 is a diagram illustrating an example of a schematic configuration of a liquid crystal display system according to a third embodiment. FIG. 10 is a diagram illustrating an example of a block configuration of a liquid crystal display device according to the third embodiment. FIG. 11 is a diagram illustrating an example of a block configuration of an operation detection circuit in the liquid crystal display device according to the third embodiment. The same components as those described in the embodiments described above are assigned with the same reference numerals, and the description thereof will not be repeated.

In the first and second embodiments, the examples have been illustrated in which the common voltage detection signal VcomIN supplied from the common electrode COM is monitored, and the transient potential variation component in synchronization with the rising edges of the pixel signal Vpix is detected. In the present embodiment, description will be given of an example of detecting the transient potential variation components in synchronization with the rising edges and the falling edges of the pixel signal Vpix, respectively.

As illustrated in FIG. 9, a liquid crystal display device 1*a* includes the display area 21 and the driver IC 3 that are provided on the glass substrate 11, and the driver IC 3 is coupled with a control device 2*a* via the relay board 12 constituted by, for example, a flexible printed circuit (FPC), thus constituting a liquid crystal display system 100*a*, in the same manner as in the liquid crystal display device 1 according to the first embodiment.

As illustrated in FIG. 10, the liquid crystal display device 1*a* according to the present embodiment includes the display area 21, the gate driver 22, the source driver 23, a display control circuit 4*a*, the voltage generation circuit 5, and an operation detection circuit (detection circuit) 6*a*. In the example illustrated in FIG. 10, the control device 2*a* outputs two threshold setting signals of a first threshold setting signal ThLEV1 and a second threshold setting signal ThLEV2 to the operation detection circuit 6*a*.

In the third embodiment, in order to detect the variation in the potential of the common electrode COM corresponding to the variation in each of the pixel signals Vpix, the operation detection circuit 6*a* is supplied from the display control circuit 4*a* with a clock signal CLKa in synchronization with each of the rising edges and the falling edges of the pixel signals Vpix, as illustrated in FIG. 10. In order to prevent an omission in reading of the variation in the potential of the common electrode COM, the operation detection circuit 6*a* is supplied with the clock signal CLKa that takes into account the delay time and the fluctuations of the internal signals. Specifically, a clock edge (such as a rising edge) of the clock signal CLKa for reading a first potential variation component detection signal VcomDET1 is supplied later, by a short time, than a voltage variation edge (a rising edge) of each of the pixel signals Vpix; and a clock edge (such as a falling edge) of the clock signal CLKa for reading a second potential variation component detection signal VcomDET2 is supplied later, by a short time, than a voltage variation edge (a falling edge) of each of the pixel signals Vpix.

As illustrated in FIG. 11, the operation detection circuit 6*a* includes a first potential variation detector 61*a*, a second potential variation detector 61*b*, and an operational state signal generator 62*a*.

As an example, each of the first potential variation detector 61*a* and the second potential variation detector 61*b* includes a comparator circuit and resistors for setting the threshold, and is configured to determine the threshold based on the voltage of a VcomDC terminal supplied with the voltage of the common electrode COM and on the resistance values. The value of the first threshold setting signal ThLEV1 can be set for the first potential variation detector 61*a* through a register setting in the control device 2*a*, and the first threshold setting signal ThLEV1, in turn, sets the resistance value of a variable resistor so that a first threshold Th1 of the first potential variation detector 61*a* can be appropriately set. The value of the second threshold setting signal ThLEV2 can be set for the second potential variation detector 61*b* through a register setting in the control device 2*a*, and the second threshold setting signal ThLEV2, in turn, sets the resistance value of a variable resistor so that a second threshold Th2 of the second potential variation detector 61*b* can be appropriately set. The first potential variation detector 61*a* extracts a potential variation component higher than the first threshold Th1 from the common voltage detection signal VcomIN, and outputs the first potential variation component detection signal VcomDET1. The second potential variation detector 61*b* extracts a potential variation component lower than the second threshold Th2 from the common voltage detection signal VcomIN, and outputs the second potential variation component detection signal VcomDET2. In the example illustrated in FIGS. 10 and 11, the first and second threshold setting signals ThLEV1 and ThLEV2 are supplied from the control device 2*a*. However, the first and second threshold setting signals ThLEV1 and ThLEV2 may be supplied from the display control circuit 4*a*.

The operational state signal generator 62*a* has a function of processing the first potential variation component detection signal VcomDET1 output from the first potential variation detector 61*a* and the second potential variation component detection signal VcomDET2 output from the second potential variation detector 61*b* so as to generate the operational state detection signal VcomMON for indicating an operational state of the liquid crystal display device 1*a*, and outputting the operational state detection signal VcomMON to the control device 2*a*.

In the example illustrated in FIG. 11, the operational state signal generator 62*a* includes level shifters 621*a* and 621*b*, logical operators 622*a* and 622*b*, an AND operator 623*a*, and the level shifter 624.

The level shifter 621*a* is a functional block for shifting the voltage level of the first potential variation component detection signal VcomDET1 output from the first potential variation detector 61*a* to a voltage level that can be handled as a digital signal in the logical operator 622*a* at the subsequent stage, and for outputting the shifted signal. The level shifter 621*b* is a functional block for shifting the voltage level of the second potential variation component detection signal VcomDET2 output from the second potential variation detector 61*b* to a voltage level that can be handled as a digital signal in the logical operator 622*b* at the subsequent stage, and for outputting the shifted signal.

The logical operator 622*a* includes a circuit for acquiring the first potential variation component detection signal VcomDET1 detected by the first potential variation detector 61*a*. The logical operator 622*b* includes a circuit for acquiring the second potential variation component detection signal VcomDET2 detected by the second potential variation detector 61*b*. The clock signal CLKa supplied to the logical operators 622*a* and 622*b* is in synchronization with the first and second potential variation component detection signals VcomDET1 and VcomDET2 so that the logical operators 622*a* and 622*b* can acquire the first and second potential variation component detection signals VcomDET1 and VcomDET2, respectively. Moreover, in order to prevent an omission in reading of the variation in the potential of the common electrode COM, the logical operators 622*a* and 622*b* are supplied with the clock signal CLKa that takes into account the delay time and the fluctuations of the internal signals. Specifically, the clock edge (such as a rising edge) of the clock signal CLKa for reading the first potential variation component detection signal VcomDET1 is supplied later, by a short time, than the voltage variation edge (a rising edge) of each of the pixel signals Vpix and the first potential variation component detection signal VcomDET1, and the clock edge (such as a falling edge) of the clock signal CLKa for reading the second potential variation component detection signal VcomDET2 is supplied later, by a short time, than the voltage variation edge (a falling edge) of each of the pixel signals Vpix and the second potential variation component detection signal VcomDET2. The first potential variation component detection signal VcomDET1 may be read at a falling edge of the clock signal CLKa, and the second potential variation component detection signal VcomDET2 may be read at a rising edge of the clock signal CLKa. The logical operators 622*a* and 622*b* are, for example, flip-flops. As will be described later, each of the logical operators 622*a* and 622*b* is, as an example, a functional block for converting the potential variation component of the common voltage Vcom into a signal that is switched between the low level and the high level within each horizontal period (1H).

The AND operator 623*a* is a functional block for selecting, based on the operation detection enable signal DetEnable supplied from the control device 2*a*, whether to output the output result of the operation detection circuit 6*a* to the control device 2*a*.

The level shifter 624 is a functional block for shifting the output of the AND operator 623*a* to a voltage level that can be handled by the control device 2*a* at the subsequent stage, and for outputting the shifted signal, as the operational state detection signal VcomMON.

Figure 12:
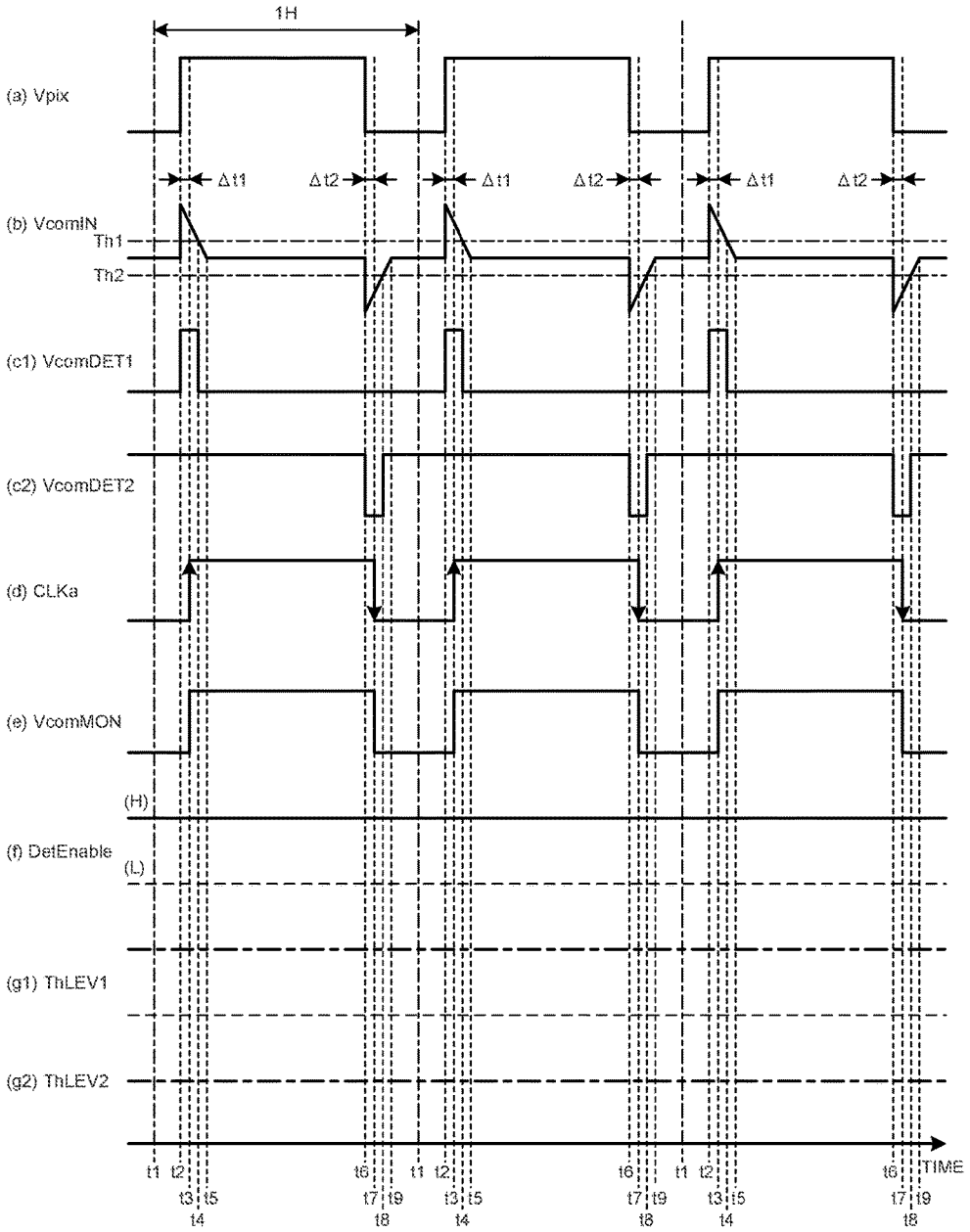
FIG. 12 is a diagram illustrating an example of a timing diagram during a normal operation of the liquid crystal display device according to the third embodiment.

FIG. 12 is a diagram illustrating an example of a timing diagram during the normal operation of the liquid crystal display device according to the third embodiment. Row (a) of FIG. 12 illustrates a waveform of each of the pixel signals Vpix supplied from the source driver 23 to corresponding one of the signal lines. Row (b) of FIG. 12 illustrates a waveform of the common voltage detection signal VcomIN detected at the common voltage detection position B of the common electrode COM. Row (c1) of FIG. 12 illustrates a waveform of the first potential variation component detection signal VcomDET1 output from the first potential variation detector 61*a*. Row (c2) of FIG. 12 illustrates a waveform of the second potential variation component detection signal VcomDET2 output from the second potential variation detector 61*b*. Row (d) of FIG. 12 illustrates a waveform of the clock signal CLKa output from the display control circuit 4*a*. Row (e) of FIG. 12 illustrates a waveform of the operational state detection signal VcomMON output from the operation detection circuit 6*a*. Row (f) of FIG. 12 illustrates the operation detection enable signal DetEnable supplied from the control device 2*a*. Row (g1) of FIG. 12 illustrates the first threshold setting signal ThLEV1 supplied from the control device 2*a*. Row (g2) of FIG. 12 illustrates the second threshold setting signal ThLEV2 supplied from the control device 2*a*. While, in this example, the first potential variation component detection signal VcomDET1 is acquired at rising edges of the clock signal CLKa, the first potential variation component detection signal VcomDET1 may be acquired at falling edges of the clock signal CLKa. Also, while the second potential variation component detection signal VcomDET2 is acquired at the falling edges of the clock signal CLKa, the second potential variation component detection signal VcomDET2 may be acquired at the rising edges of the clock signal CLKa.

In this manner, in the present embodiment, the liquid crystal display device is configured to detect both a potential variation component of the common voltage detection signal VcomIN (positive side variation component) that changes toward the positive side along with the rise of the pixel signal Vpix and a potential variation component of the common voltage detection signal VcomIN (negative side variation component) that changes toward the negative side along with the fall of the pixel signal Vpix. This configuration can improve the detection accuracy of the common voltage detection signal VcomIN more than in the case of detecting the transient potential variation component in synchronization with only either of the rising edges and the falling edges of the pixel signal Vpix.

The following describes an operation of the liquid crystal display device according to the third embodiment while the liquid crystal display device is functioning normally, with reference to FIGS. 10 to 12.

When the common voltage detection signal VcomIN becomes higher than the first threshold Th1 in a period of t2 to t5 in Row (b) of FIG. 12, the first potential variation component detection signal VcomDET1 changes from a low level to a high level at a point where the common voltage detection signal VcomIN exceeds the first threshold Th1 (in a period of t2 to t4 in Row (c1) of FIG. 12).

If the level of the first potential variation component detection signal VcomDET1 is the high level at a rising edge of the clock signal CLKa (at t3 in Row (d) of FIG. 12) that rises later, by a short time Δt1, than the pixel signal Vpix, the operational state detection signal VcomMON changes to the high level.

When the common voltage detection signal VcomIN subsequently becomes lower than the second threshold Th2 in a period of t6 to t9 in Row (b) of FIG. 12, the second potential variation component detection signal VcomDET2 changes from a high level to a low level at a point where the common voltage detection signal VcomIN becomes lower than the second threshold Th2 (in a period of t6 to t8 in Row (c2) of FIG. 12).

If the level of the second potential variation component detection signal VcomDET2 is the low level at a falling edge of the clock signal CLKa (at t7 in Row (d) of FIG. 12) that falls later, by a short time Δt2, than the pixel signal Vpix, the operational state detection signal VcomMON changes to the low level.

From then on, the above-described operation is repeated at intervals of one horizontal period (1H) so as to output, as the operational state detection signal VcomMON, the first signal indicating that the potential variation component of the common electrode COM is detected. Here, the first signal is a signal changing to the high level at the rising edges of the clock signal CLKa and to the low level at the falling edges of the clock signal CLKa, that is, a signal switched between the low level and the high level within each horizontal period (1H). The second signal indicating that the potential variation component of the common electrode COM is not detected and serving as the operational state detection signal VcomMON is the same as the signal fixed to the low level in the first embodiment.

As described above, in the present embodiment, when the liquid crystal display device monitors the common voltage detection signal VcomIN supplied from the common electrode COM and detects the transient potential variation components in synchronization with the pixel signal Vpix, the liquid crystal display device detects the transient potential variation components in synchronization with the rising edge and the falling edge of the pixel signal Vpix, respectively, that is, the display device detects both the potential variation component higher than the first threshold Th1 extracted from the common voltage detection signal VcomIN and the potential variation component lower than the second threshold Th2 extracted from the common voltage detection signal VcomIN. This configuration can improve the detection accuracy of the common voltage detection signal VcomIN more than in the case of detecting the transient potential variation component in synchronization with only either of the rising edges and the falling edges of the pixel signal Vpix.

As described above, the liquid crystal display device 1*a* according to the third embodiment is configured to detect both the potential variation component of the common voltage detection signal VcomIN (positive side variation component) that changes toward the positive side along with the rise of the pixel signal Vpix and the potential variation component of the common voltage detection signal VcomIN (negative side variation component) that changes toward the negative side along with the fall of the pixel signal Vpix. This configuration can improve the detection accuracy of the common voltage detection signal VcomIN more than in the case of detecting the transient potential variation component in synchronization with only either of the rising edges and the falling edges of the pixel signal Vpix.

Fourth Embodiment

Figure 13:
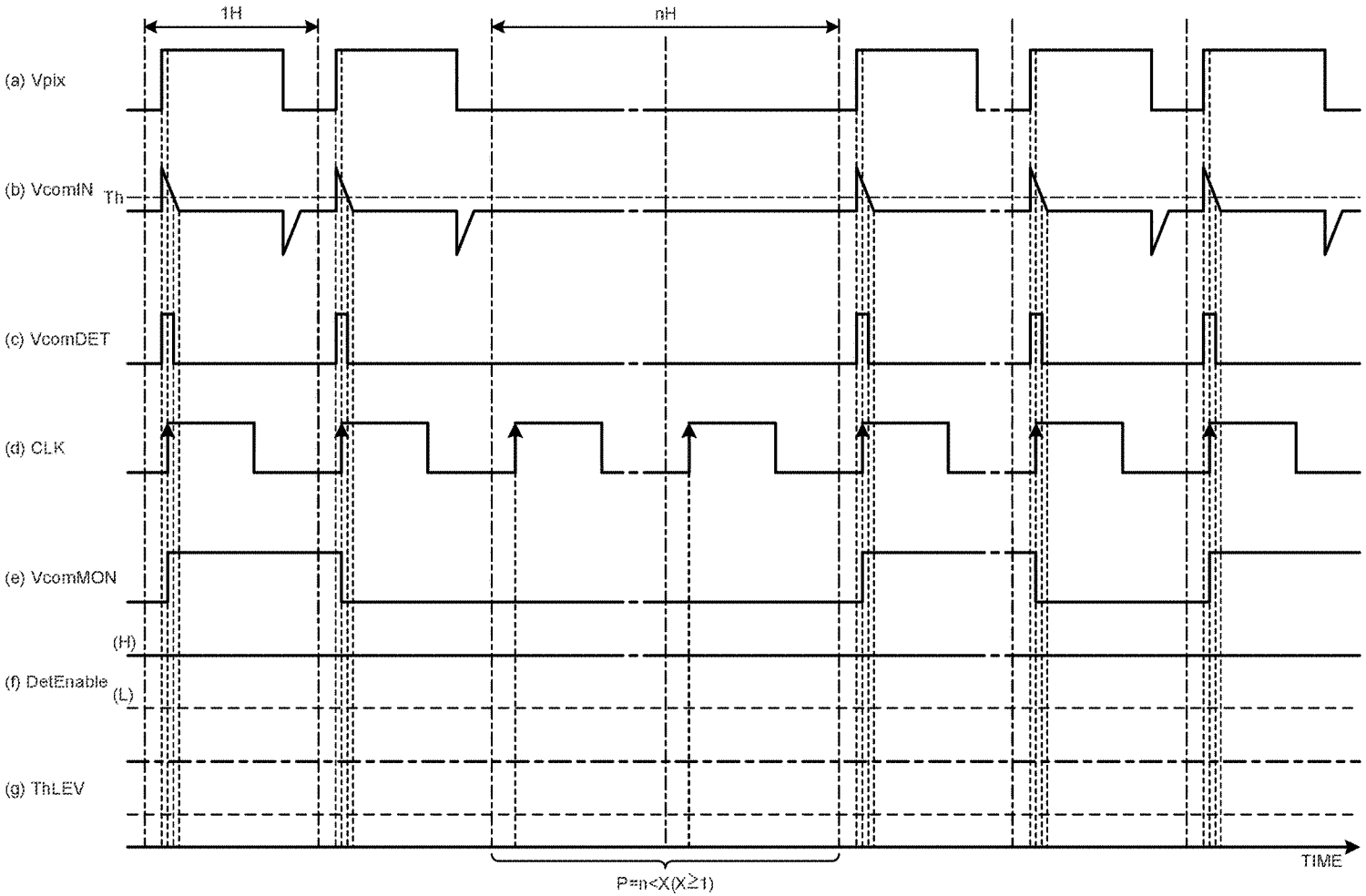
FIG. 13 is a diagram illustrating an example of a timing diagram of a liquid crystal display device according to a fourth embodiment.

FIG. 13 is a diagram illustrating an example of a timing diagram of a liquid crystal display device according to a fourth embodiment. The schematic configuration of the liquid crystal display system, the block configuration of the liquid crystal display device, and the block configuration of the operation detection circuit in the liquid crystal display device according to the fourth embodiment are the same as those of the first embodiment described above, so that the description thereof will not be repeated.

When the common voltage detection signal VcomIN exceeds the threshold Th, the potential variation component detection signal VcomDET changes from the low level to the high level. When the common voltage detection signal VcomIN does not exceed the threshold Th, the potential variation component detection signal VcomDET remains at the low level.

If the level of the potential variation component detection signal VcomDET is the high level at a rising edge of the clock signal CLK, that is, if the potential variation component of the common electrode COM is detected, the operational state signal generator 62 outputs, as the operational state detection signal VcomMON, the first signal indicating that the potential variation component of the common electrode COM is detected. In the present embodiment, the first signal is a signal switched between the low level and the high level at the rising edges of the clock signal CLK, that is, a signal switched between the low level and the high level at intervals of one horizontal period (1H), in the same manner as in the first embodiment.

If, instead, the level of the potential variation component detection signal VcomDET is the low level at the rising edge of the clock signal CLK, that is, if the potential variation component of the common electrode COM is not detected, the operational state signal generator 62 outputs, as the operational state detection signal VcomMON, the second signal indicating that the potential variation component of the common electrode COM is not detected. As described in the first embodiment, the second signal in the present embodiment is a signal fixed to the low level or the high level, that is, a signal that does not change from the low level or the high level at intervals of one horizontal period (1H).

In the present embodiment, failure detection of the display operation of the liquid crystal display device 1 is performed at intervals of one horizontal period (1H), and a certain count X (X is, for example, a natural number of 1 or larger, that is, $X \geq 1$) is defined as a threshold for a count (hereinafter, called a "consecutive failure detection count") P of consecutive detection of the second signal by the control device 2. In the example illustrated in FIG. 13, the consecutive failure detection count P of detection of the second signal by the control device 2 in n horizontal periods (nH) equals n (p=n).

In the liquid crystal display system 100 according to the present embodiment, the control device 2 determines that the liquid crystal display device 1 is functioning abnormally or has stopped operating if the consecutive failure detection count P reaches the certain count X or larger ($P \geq X$). In other words, the control device 2 determines that the liquid crystal display device 1 is functioning normally if the consecutive failure detection count P is smaller than the certain count X ($P < X$). This configuration can prevent the liquid crystal display device 1 from being falsely detected as being functioning abnormally or having stopped operating even though the liquid crystal display device 1 is functioning normally, when, for example, a disturbance factor such as noise has caused the common voltage detection signal VcomIN to fail to be detected once or for a short period, or has caused the potential variation component detection signal VcomDET to fail to be acquired.

Parameter values that include, for example, the certain count X in the present embodiment, and are used for detecting a failure in the display operation of the liquid crystal display device 1 may be set in advance through the register setting in the control device 2, or may be dynamically changed according to environmental factors in the liquid crystal display system 100 (such as temperature characteristics of components constituting the liquid crystal display system 100).

Figure 14:
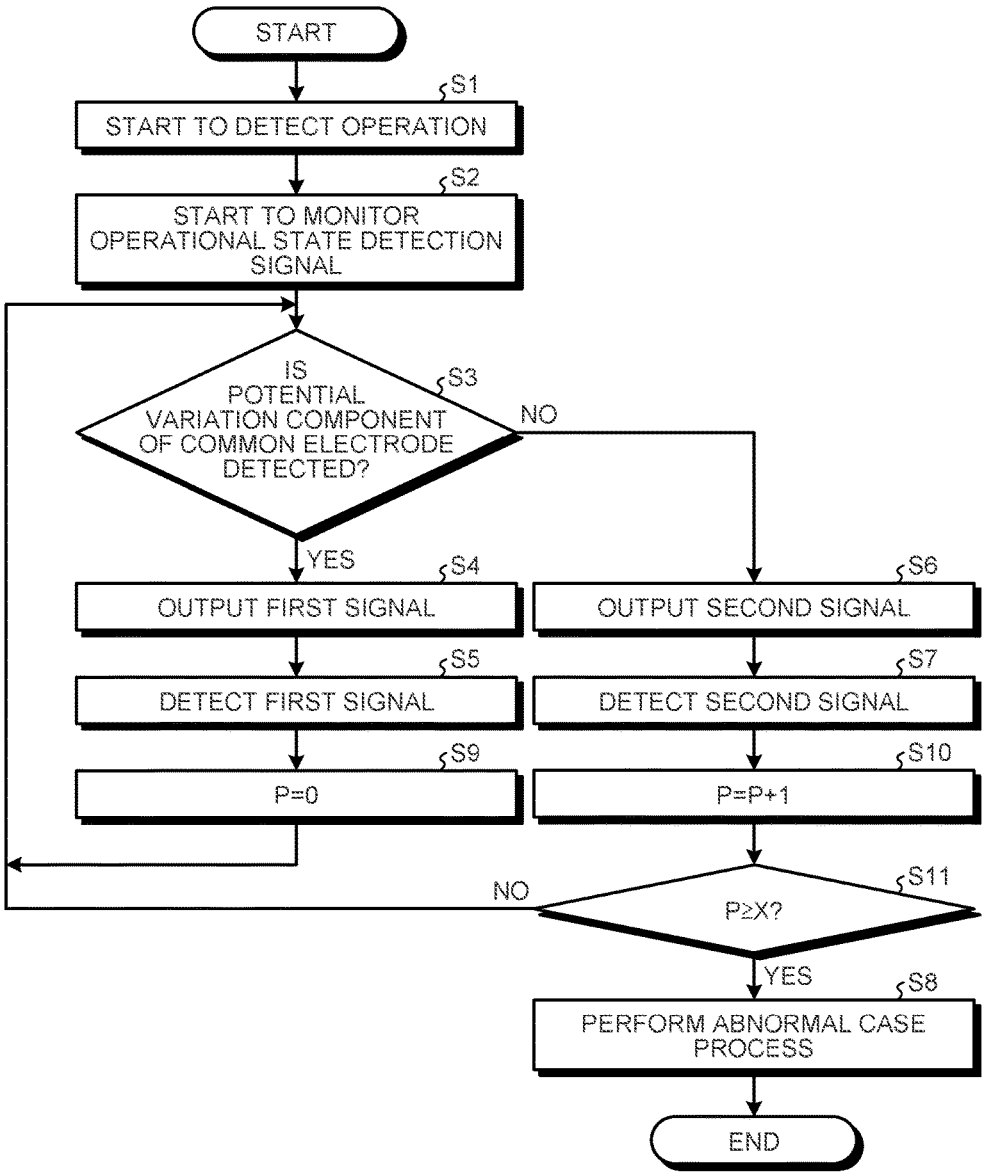
FIG. 14 is a diagram illustrating an example of a processing procedure in a liquid crystal display system according to the fourth embodiment.

The following describes a specific processing procedure in the liquid crystal display system 100 according to the fourth embodiment, with reference to FIGS. 2, 3, 13, and 14. FIG. 14 is a diagram illustrating an example of the processing procedure in the liquid crystal display system according to the fourth embodiment. The processing procedure in the present embodiment is performed at intervals of one horizontal period (1H).

After the liquid crystal display device 1 starts operating, the operation detection enable signal DetEnable (high-level signal) and the threshold setting signal ThLEV are supplied from the control device 2 to the operation detection circuit 6. The supply of the threshold setting signal ThLEV sets the threshold Th of the potential variation detector 61 through the register setting. The operation detection circuit 6 compares the common voltage detection signal VcomIN from the common electrode COM with the threshold Th, and starts to detect the operation (Step S1). The control device 2 starts to monitor the operational state detection signal VcomMON (Step S2).

The operational state signal generator 62 determines, at the rising edges of the clock signal CLK, whether the level of the potential variation component detection signal VcomDET is the high level. In this manner, the operational state signal generator 62 determines whether the potential variation component of the common electrode COM is detected (Step S3).

If the level of the potential variation component detection signal VcomDET is the high level at a rising edge of the clock signal CLK, that is, if the potential variation component of the common electrode COM is detected (Yes at Step S3), the operational state signal generator 62 outputs, as the operational state detection signal VcomMON, the first signal indicating that the potential variation component of the common electrode COM is detected, based on the operation detection enable signal DetEnable (high-level signal) (Step S4). Here, the first signal is a signal switched between the low level and the high level at the rising edges of the clock signal CLK, that is, a signal switched between the low level and the high level at intervals of one horizontal period (1H).

After detecting the first signal output at Step S4 (Step S5), the control device 2 resets the consecutive failure detection count P (P=0) (Step S9), and the process returns to Step S3.

If the level of the potential variation component detection signal VcomDET is the low level at the rising edge of the clock signal CLK, that is, if the potential variation component of the common electrode COM is not detected (No at Step S3), the operational state signal generator 62 outputs, as the operational state detection signal VcomMON, the second signal indicating that the potential variation component of the common electrode COM is not detected (Step S6). Here, the second signal is a signal fixed to the low level.

After detecting the second signal output at Step S6 (Step S7), the control device 2 increments the consecutive failure detection count P (P=P+1) (Step S10), and determines whether the consecutive failure detection count P is the certain count X or larger (P≥X) (Step S11).

If the consecutive failure detection count P is smaller than the certain count X (P<X) (No at Step S11), the process returns to Step S3.

If the consecutive failure detection count P is the certain count X or larger (P≥X) (Yes at Step S11), the control device 2 determines that an failure has occurred in the display operation of the liquid crystal display device 1, and performs the certain abnormal case process (Step S8). Then, the process of this procedure ends.

That is to say, in the present embodiment, if the operational state signal generator 62 detects the potential variation component of the common electrode COM (Yes at Step S3) and outputs the first signal (Step S4) before the consecutive failure detection count P of consecutive detection of the second signal reaches X or larger (P≥X), the control device 2 determines that the liquid crystal display device 1 is functioning normally, and hence, does not perform the abnormal case process (Step S8).

This configuration can prevent the liquid crystal display device 1 from being falsely detected as being functioning abnormally or having stopped operating even though the liquid crystal display device 1 is functioning normally, when, for example, a disturbance factor such as noise has caused the common voltage detection signal VcomIN to fail to be detected once or for a short period, or has caused the potential variation component detection signal VcomDET to fail to be acquired.

In the present embodiment, after the control device 2 determines that a failure has occurred in the display operation of the liquid crystal display device 1 and performs the certain abnormal case process, the liquid crystal display device 1 restarts to operate, and the operation detection circuit 6 starts to detect the operation (Step S1). Then, if the control device 2 detects the first signal (Step S5), the consecutive failure detection count P is reset (P=0) (Step S9). If, instead, the control device 2 detects the second signal (Step S7) immediately after the operation detection circuit 6 starts detecting the operation after the liquid crystal display device 1 starts operating, the consecutive failure detection count P is incremented (P=P+1) (Step S10). Then, the consecutive failure detection count P is determined to be the certain count X or larger (P≥X) at Step S11, so that the abnormal case process is immediately performed (Step S8).

As described above, the control device 2 of the liquid crystal display system 100 according to the fourth embodiment sets the certain count X as the threshold for the consecutive failure detection count P of consecutive detection of the second signal, and determines that the failure has occurred in the display operation of the liquid crystal display device 1 if the consecutive failure detection count P reaches the certain count X or larger (P≥X). In other words, the control device 2 determines that the liquid crystal display device 1 is functioning normally if the consecutive failure detection count P is smaller than the certain count X (P<X). This configuration can prevent the liquid crystal display device 1 from being falsely detected as being functioning abnormally or having stopped operating even though the liquid crystal display device 1 is functioning normally, when, for example, a disturbance factor such as noise has caused the common voltage detection signal VcomIN to fail to be detected once or for a short period, or has caused the potential variation component detection signal VcomDET to fail to be acquired.

Fifth Embodiment

Figure 15:
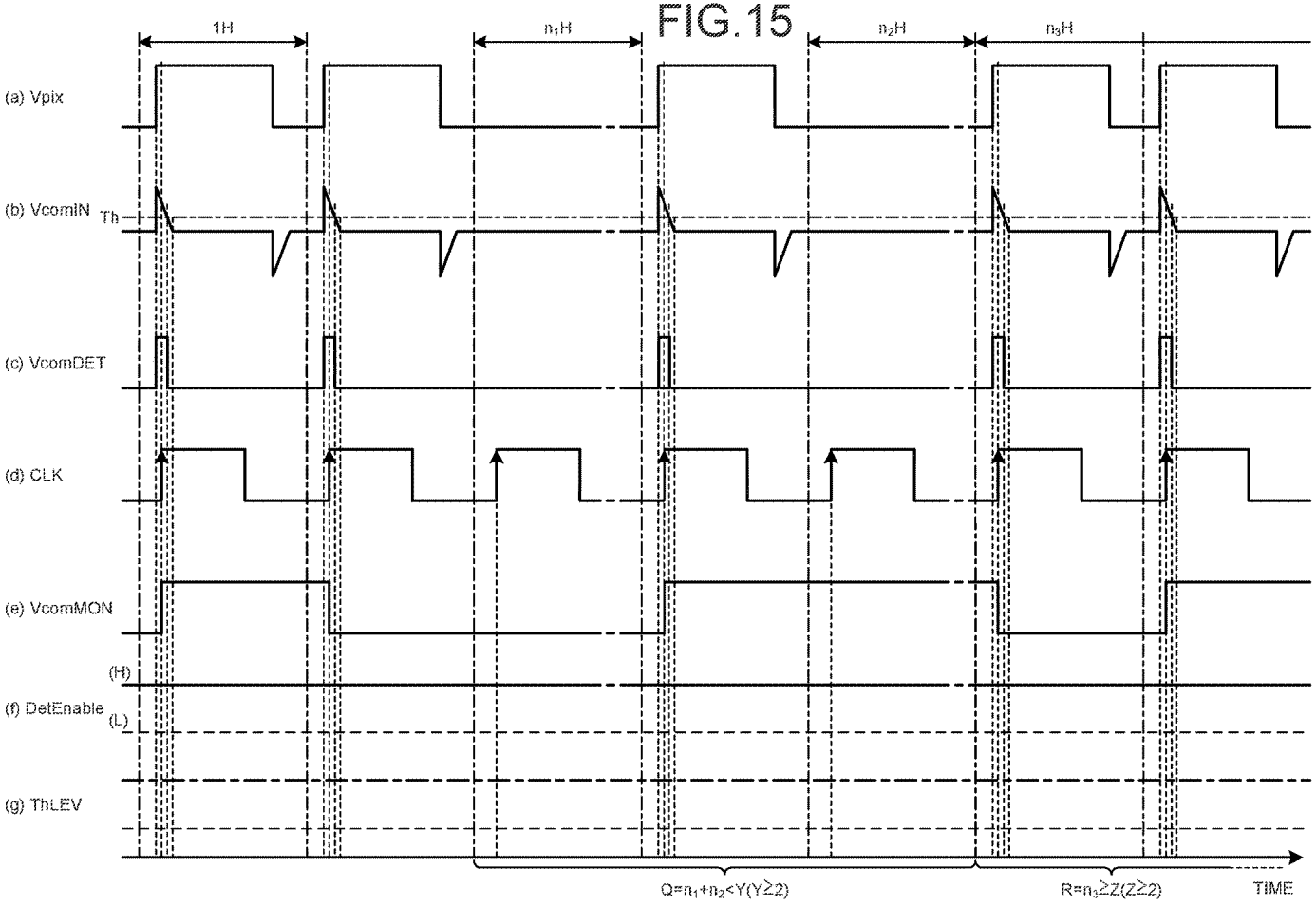
FIG. 15 is a diagram illustrating an example of a timing diagram of a liquid crystal display device according to a fifth embodiment.

FIG. 15 is a diagram illustrating an example of a timing diagram of a liquid crystal display device according to a fifth embodiment. The schematic configuration of the liquid crystal display system, the block configuration of the liquid crystal display device, and the block configuration of the operation detection circuit in the liquid crystal display device according to the fifth embodiment are the same as those of the first embodiment described above, so that the description thereof will not be repeated.

In the fourth embodiment, the example has been described in which the certain count X (X is, for example, a natural number of 1 or larger, that is, X 1) is defined as the threshold for the consecutive failure detection count P of consecutive detection of the second signal by the control device 2, and a failure is determined to have occurred in the display operation of the liquid crystal display device 1 if the consecutive failure detection count P reaches the certain count X or larger (P≥X). In the present embodiment, a first certain count Y (Y is, for example, a natural number of 2 or larger, that is, Y≥2) is defined as a threshold for a cumulative count (hereinafter, called a "cumulative failure detection count") Q of detection of the second signal by the control device 2. In the example illustrated in FIG. 15, the cumulative count Q of detection of the second signal by the control device 2 in $n_1$H and $n_2$H equals ($n_1+n_2$), that is, $Q=n_1+n_2$.

In the present embodiment, a second certain count Z (Z is, for example, a natural number of 2 or larger, that is, Z≥2) is defined as a threshold for a consecutive normality detection count R of consecutive detection of the first signal by the control device 2. In the example illustrated in FIG. 15, the consecutive normality detection count R of detection of the first signal by the control device 2 in $n_3$H equals $n_3$ ($R=n_3$).

In the liquid crystal display system 100 according to the present embodiment, the control device 2 determines that the liquid crystal display device 1 is functioning abnormally or has stopped operating if the cumulative failure detection count Q reaches the first certain count Y or larger (Q≥Y). In other words, the control device 2 determines that the liquid crystal display device 1 is functioning normally if the cumulative failure detection count Q is smaller than the first certain count Y (Q<Y) and the consecutive normality detection count R reaches the second certain count Z or larger (R≥Z). In this manner, the value of the first certain count Y for the cumulative failure detection count Q and the value of the second certain count Z for the consecutive normality detection count R are appropriately set in accordance with the system, so that a failure in the display operation of the liquid crystal display device 1 can be more accurately detected.

Parameter values that include, for example, the first certain count Y and the second certain count Z in the present embodiment and are used for detecting a failure in the display operation of the liquid crystal display device 1 may be set in advance through the register setting in the control device 2, or may be dynamically changed according to the environmental factors in the liquid crystal display system 100 (such as the temperature characteristics of the components constituting the liquid crystal display system 100).

Figure 16:
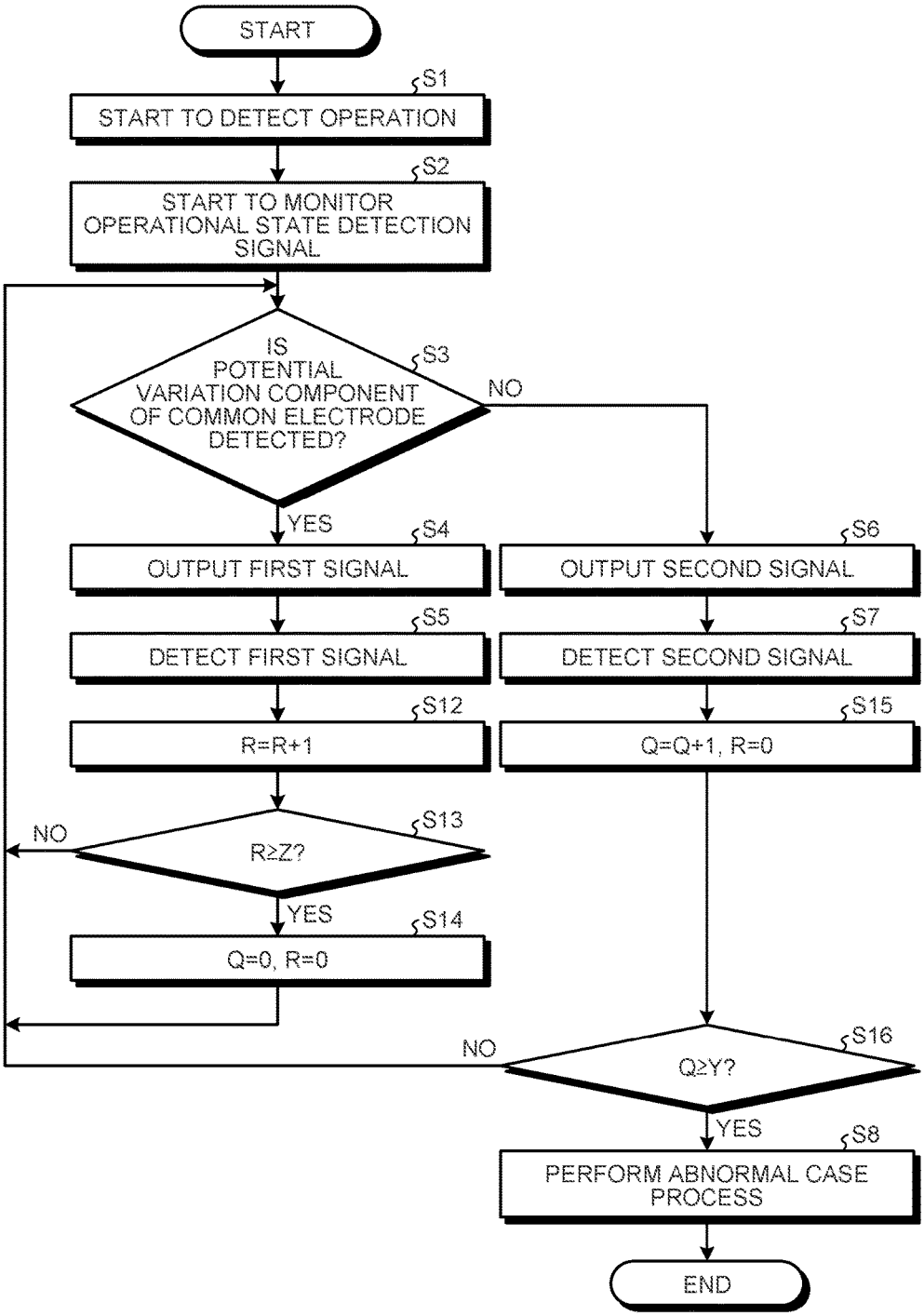
FIG. 16 is a diagram illustrating an example of a processing procedure in a liquid crystal display system according to the fifth embodiment.

The following describes a specific processing procedure in the liquid crystal display system 100 according to the fifth embodiment, with reference to FIGS. 2, 3, 15, and 16. FIG. 16 is a diagram illustrating an example of a processing procedure in the liquid crystal display system according to the fifth embodiment. The processing procedure in the present embodiment is performed at intervals of one horizontal period (1H).

After the liquid crystal display device 1 starts operating, the operation detection enable signal DetEnable (high-level signal) and the threshold setting signal ThLEV are supplied from the control device 2 to the operation detection circuit 6. The supply of the threshold setting signal ThLEV sets the threshold Th of the potential variation detector 61 through the register setting. The operation detection circuit 6 compares the common voltage detection signal VcomIN from the common electrode COM with the threshold Th, and starts to detect the operation (Step S1). The control device 2 starts to monitor the operational state detection signal VcomMON (Step S2).

The operational state signal generator 62 determines, at the rising edges of the clock signal CLK, whether the level of the potential variation component detection signal VcomDET is the high level. In this manner, the operational state signal generator 62 determines whether the potential variation component of the common electrode COM is detected (Step S3).

If the level of the potential variation component detection signal VcomDET is the high level at a rising edge of the clock signal CLK, that is, if the potential variation component of the common electrode COM is detected (Yes at Step S3), the operational state signal generator 62 outputs, as the operational state detection signal VcomMON, the first signal indicating that the potential variation component of the common electrode COM is detected, based on the operation detection enable signal DetEnable (high-level signal) (Step S4). Here, the first signal is a signal switched between the low level and the high level at the rising edges of the clock signal CLK, that is, a signal switched between the low level and the high level at intervals of one horizontal period (1H).

After detecting the first signal output at Step S4 (Step S5), the control device 2 increments the consecutive normality detection count R (R=R+1) (Step S12), and determines whether the consecutive normality detection count R is the second certain count Z or larger (R≥Z) (Step S13).

If the consecutive normality detection count R is smaller than the second certain count Z (R<Z) (No at Step S13), the process returns to Step S3.

If the consecutive normality detection count R reaches the second certain count Z or larger (R≥Z) (Yes at Step S13), the control device 2 resets the cumulative failure detection count Q and the consecutive normality detection count R (Q=0 and R=0) (Step S14), the process returns to Step S3.

If the level of the potential variation component detection signal VcomDET is the low level at the rising edge of the clock signal CLK, that is, if the potential variation component of the common electrode COM is not detected (No at Step S3), the operational state signal generator 62 outputs, as the operational state detection signal VcomMON, the second signal indicating that the potential variation component of the common electrode COM is not detected (Step S6). Here, the second signal is a signal fixed to the low level.

After detecting the second signal output at Step S6 (Step S7), the control device 2 increments the cumulative failure detection count Q (Q=Q+1), and resets the consecutive normality detection count R (R=0) (Step S15). Then, the control device 2 determines whether the cumulative failure detection count Q is the first certain count Y or larger (Q≥Y) (Step S16).

If the cumulative failure detection count Q is smaller than the first certain count Y (Q<Y) (No at Step S16), the process returns to Step S3.

If the cumulative failure detection count Q reaches the first certain count Y or larger (Q≥Y) (Yes at Step S16), the control device 2 determines that the liquid crystal display device 1 is functioning abnormally or has stopped operating, and performs the certain abnormal case process (Step S8). Then, the process of this procedure ends.

That is to say, in the present embodiment, if the potential variation component of the common electrode COM is detected (Yes at Step S3) and the consecutive normality detection count R of consecutive detection of the first signal reaches the second certain count Z (Z≥2) or larger (R≥Z) (Yes at Step S13) before the first certain count Y (Y is a natural number of 2 or larger, that is, Y≥2) is reached by the cumulative failure detection count Q serving as the cumulative count of detection of the second signal, the control device 2 determines that the liquid crystal display device 1 is functioning normally, and hence, does not perform the abnormal case process (Step S8).

In this manner, the value of the first certain count Y for the cumulative failure detection count Q and the value of the second certain count Z for the consecutive normality detection count R are appropriately set in accordance with the system, so that a failure in the display operation of the liquid crystal display device 1 can be detected more accurately than in the fourth embodiment.

In the present embodiment, after the control device 2 determines that a failure has occurred in the display operation of the liquid crystal display device 1 and performs the certain abnormal case process, the liquid crystal display device 1 restarts to operate, and the operation detection circuit 6 starts to detect the operation (Step S1). Then, if the control device 2 detects the first signal (Step S5), the cumulative failure detection count Q and the consecutive normality detection count R are reset (Q=0 and R=0) (Step S14). If, instead, the control device 2 detects the second signal (Step S7) immediately after the operation detection circuit 6 starts detecting the operation after the liquid crystal display device 1 starts operating, the cumulative failure detection count Q is incremented (Q=Q+1), and the consecutive normality detection count R is reset (R=0) (Step S15). Then, the cumulative failure detection count Q is determined to be the first certain count Y or larger (Q≥Y) at Step S16, so that the abnormal case process is immediately performed (Step S8).

As described above, the liquid crystal display system 100 according to the fifth embodiment sets the first certain count Y as the threshold for the cumulative failure detection count Q serving as the cumulative count of detection of the second signal by the control device 2, and determines that the liquid crystal display device 1 is functioning abnormally or has stopped operating if the cumulative failure detection count Q reaches the first certain count Y or larger (Q≥Y). The liquid crystal display system 100 according to the fifth embodiment also sets the second certain count Z as the threshold for the consecutive normality detection count R of consecutive detection of the first signal by the control device 2, and determines that the liquid crystal display device 1 is functioning normally if the cumulative failure detection count Q is smaller than the first certain count Y (Q<Y) and the consecutive normality detection count R reaches the second certain count Z or larger (R≥Z). In this manner, the value of the first certain count Y for the cumulative failure detection count Q and the value of the second certain count Z for the consecutive normality detection count R are appropriately set in accordance with the system, so that a failure in the display operation of the liquid crystal display device 1 can be more accurately detected.

Sixth Embodiment

Figure 17:
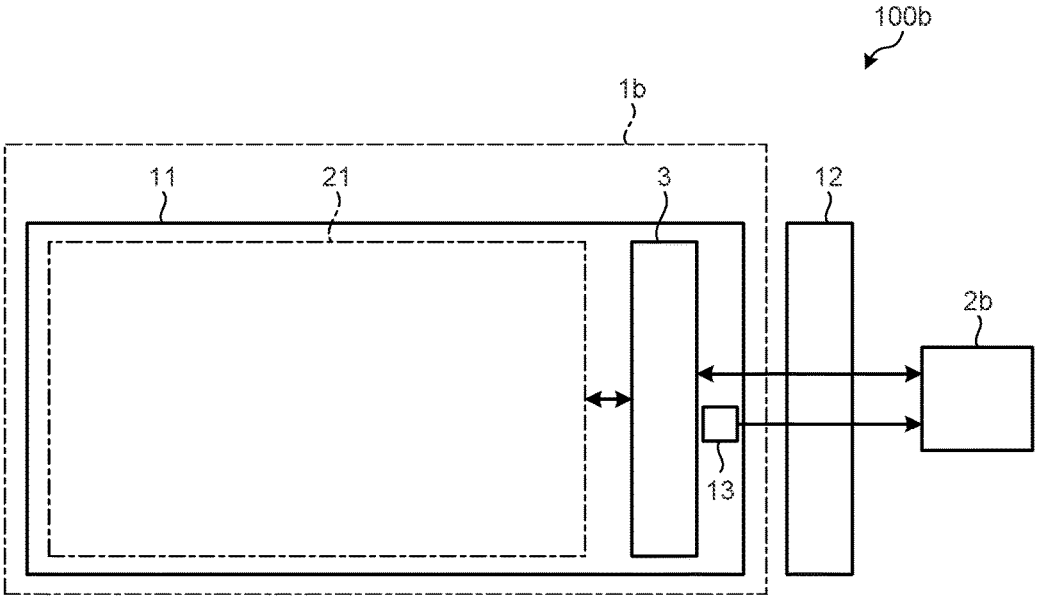
FIG. 17 is a diagram illustrating an example of a schematic configuration of a liquid crystal display system according to a sixth embodiment.
Figure 18:
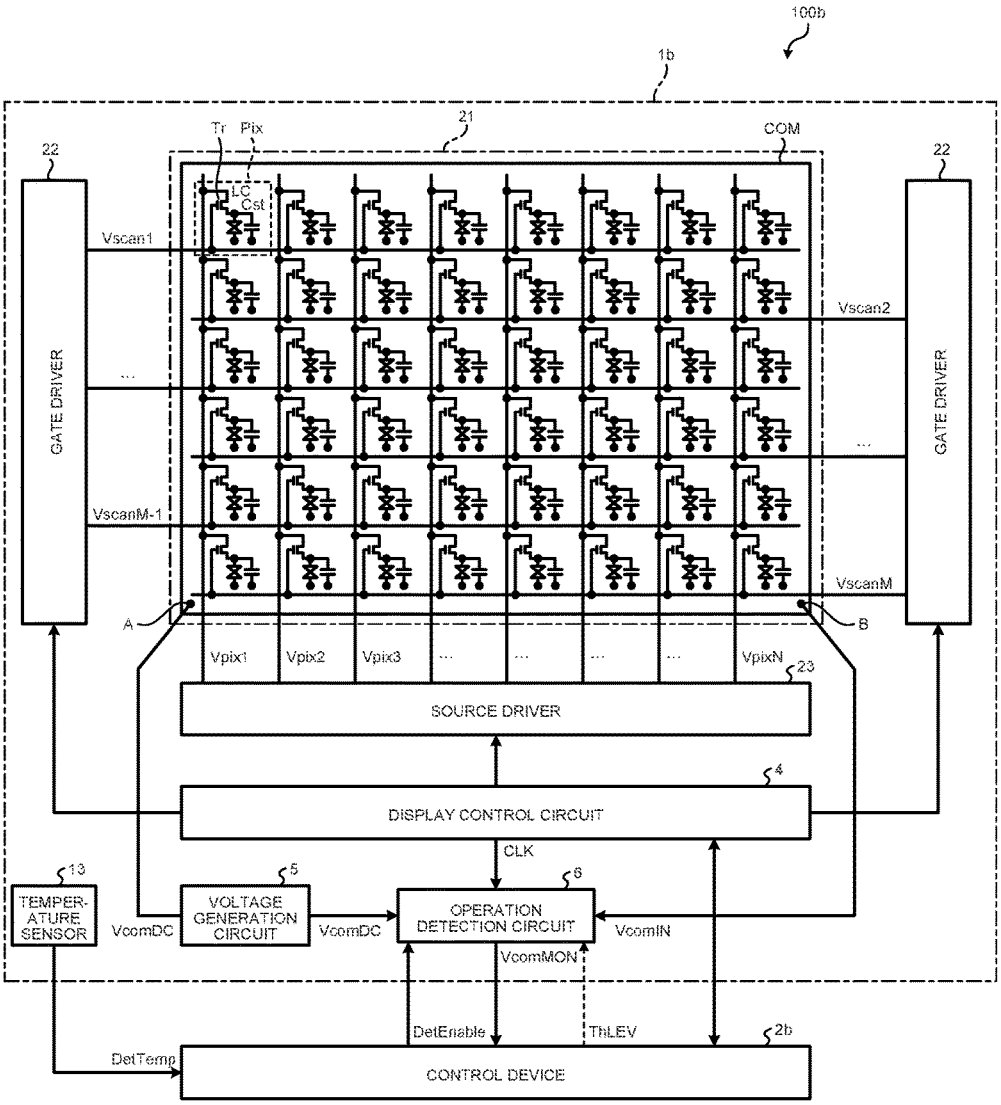
FIG. 18 is a diagram illustrating an example of a block configuration of a liquid crystal display device according to the sixth embodiment.

FIG. 17 is a diagram illustrating an example of a schematic configuration of a liquid crystal display system according to a sixth embodiment of the present invention. FIG. 18 is a diagram illustrating an example of a block configuration of a liquid crystal display device according to the sixth embodiment. The same components as those described in the embodiments described above are assigned with the same reference numerals, and the description thereof will not be repeated.

In the present embodiment, description will be given of an example in which parameter values are dynamically set according to the environmental factors in the liquid crystal display device 1*b*, the parameter values including, for example, the certain count X in the fourth embodiment, or, for example, the first certain count Y and the second certain count Z in the fifth embodiment, and being used for detecting a failure in the display operation of a liquid crystal display device 1*b*.

As illustrated in FIG. 17, the liquid crystal display device 1*b* includes the display area 21 and the driver IC 3 that are provided on the glass substrate 11, and the driver IC 3 is coupled with a control device 2*b* via the relay board 12 constituted by, for example, a flexible printed circuit (FPC), thus constituting a liquid crystal display system 100*b*, in the same manner as in the liquid crystal display device 1 according to the first embodiment.

In the present embodiment, a temperature sensor 13 is provided on the glass substrate 11, and the parameter values used for detecting a failure in the display operation of the liquid crystal display device 1*b* are dynamically set according to a temperature detected by the temperature sensor 13. That is, in the present embodiment, a failure in the display operation of the liquid crystal display device 1*b* can be detected taking into account the temperature characteristics of the components constituting the liquid crystal display device 1*b*. While the example illustrated in FIG. 17 is an example of providing the temperature sensor 13 on the glass substrate 11, the present invention is not limited to this arrangement, but the temperature sensor 13 may be placed near a component liable to be affected by temperature change, or preferably be provided at a certain location in the liquid crystal display device 1*b* where temperature greatly changes, not limited to be provided on the glass substrate 11. In particular, the detection accuracy is affected in some cases by a change in the level or timing of a signal, such as the threshold setting signal ThLEV, the threshold Th, or the clock signal CLK, used for detecting the common voltage detection signal VcomIN due to the temperature characteristics. For this reason, the temperature sensor 13 is preferably placed near the driver IC 3 including the display control circuit 4 and the operation detection circuit 6.

As illustrated in FIG. 18, the liquid crystal display device 1*b* according to the present embodiment includes the display area 21, the gate driver 22, the source driver 23, the display control circuit 4, the voltage generation circuit 5, the operation detection circuit (detection circuit) 6, and the temperature sensor 13. In the example illustrated in FIGS. 17 and 18, the threshold setting signal ThLEV is supplied from the control device 2*b*. However, the threshold setting signal ThLEV may be supplied from the display control circuit 4.

In the present embodiment, a temperature detection signal DetTemp output from the temperature sensor 13 is supplied to the control device 2*b*. The control device 2*b* dynamically sets the parameter values used for detecting a failure in the display operation of the liquid crystal display device 1*b*, according to the temperature detection signal DetTemp. This configuration allows the parameters to be appropriately set according to the temperature change at the certain location of the liquid crystal display device 1*b* where the temperature sensor 13 is provided, and thus can provide a system with low dependence on the temperature change.

In the configuration in which a plurality of parameters, such as the first certain count Y and the second certain count Z in the fifth embodiment, are used for detecting a failure in the display operation of the liquid crystal display device 1*b*, only either one of the parameters more dependent on the temperature change may naturally be set according to the temperature detection signal DetTemp, or both the parameters may naturally be set according to the temperature detection signal DetTemp.

As described above, the liquid crystal display system 100*b* according to the sixth embodiment is provided with the temperature sensor 13 for detecting the temperature at the certain location in the liquid crystal display device 1*b*, and dynamically sets the parameter values used for detecting a failure in the display operation of the liquid crystal display device 1*b*, according to the temperature detection signal DetTemp output from the temperature sensor 13. This configuration allows the parameters to be appropriately set according to the temperature change at the certain location of the liquid crystal display device 1*b* where the temperature sensor 13 is provided, and thus can provide a system with low dependence on the temperature change.

The present invention is not limited to the description of the embodiments set forth above. The components of the present invention described above include a component or components that is/are easily conceivable by those skilled in the art, substantially the same component or components, and what is/are called an equivalent or equivalents. Moreover, the components described above can be appropriately combined. The components can be variously omitted, replaced, and modified without departing from the gist of the present invention.

What is claimed is:

1. A liquid crystal display device comprising:

a plurality of pixels arranged in a matrix in a display area;

a scanning line that is coupled with pixels arranged in a row direction in the display area and is supplied with a scan signal;

a signal line that is coupled with pixels arranged in a column direction in the display area and is supplied with a pixel signal;

a common electrode that is commonly coupled with the pixels and is supplied with a common voltage; and a detection circuit including an input end coupled with the common electrode and an output end, and configured to detect a transient potential variation component that is synchronized with variation in the pixel signal and is superimposed on the common voltage, and to output the detected component from the output end, wherein the detection circuit is provided with a threshold set for detecting the potential variation component, detects the common voltage from the common electrode at a first portion thereof at which the input end of the detection circuit is coupled, and compares the detected common voltage with the threshold so as to detect the potential variation component, and the first portion of the common electrode is away from a second portion of the common electrode at which the common voltage is applied, and wherein the threshold is set to a certain value corresponding to a wave height value of the pixel signal.

2. The liquid crystal display device according to claim 1, wherein the threshold comprises a first threshold used for detecting the potential variation component changing toward a positive side along with a rise of the pixel signal and a second threshold used for detecting the potential variation component changing toward a negative side along with a fall of the pixel signal.

3. The liquid crystal display device according to claim 1, wherein the threshold is set in advance through a register setting in the detection circuit.

4. The liquid crystal display device according to claim 1, wherein the threshold is dynamically set to a value corresponding to the wave height value of the pixel signal.

5. A liquid crystal display system comprising:

the liquid crystal display device as claimed in claim 1; and a control device that determines that the liquid crystal display device is functioning abnormally or has stopped operating and that performs a certain abnormal case process if the potential variation component is not detected by the detection circuit.

6. A liquid crystal display system comprising:

the liquid crystal display device as claimed in claim 1; and a control device that detects, at intervals of one horizontal period, whether the potential variation component is detected by the detection circuit, and, if a count of consecutive detection of the potential variation component reaches a certain count, determines that the liquid crystal display device is functioning abnormally or has stopped operating and performs a certain abnormal case process.

7. The liquid crystal display system according to claim 6, further comprising a temperature sensor that detects a temperature at a certain location in the liquid crystal display device, wherein the control device dynamically sets the certain count based on the temperature detected by the temperature sensor.

8. A liquid crystal display system comprising:

the liquid crystal display device as claimed in claim 1; and a control device that detects, at intervals of one horizontal period, whether the potential variation component is detected by the detection circuit, and, if a cumulative count of detection of the potential variation component reaches a first certain count, determines that the liquid crystal display device is functioning abnormally or has stopped operating and performs a certain abnormal case process.

9. The liquid crystal display system according to claim 8, further comprising a temperature sensor that detects a temperature at a certain location in the liquid crystal display device, wherein the control device dynamically sets the first certain count based on the temperature detected by the temperature sensor.

10. The liquid crystal display system according to claim 8, wherein the control device determines that the liquid crystal display device is functioning normally if a count of consecutive non-detection of the potential variation component by the detection circuit reaches a second certain count.

11. The liquid crystal display system according to claim 10, further comprising a temperature sensor that detects a temperature at a certain location in the liquid crystal display device, wherein the control device dynamically sets at least one of the first certain count and the second certain count based on the temperature detected by the temperature sensor.

* * * * *